US011285343B2

(12) United States Patent
Paglioli et al.

(10) Patent No.: US 11,285,343 B2
(45) Date of Patent: Mar. 29, 2022

(54) BELAY DEVICE

(71) Applicant: ALUDESIGN S.P.A., Cisano Bergamasco (IT)

(72) Inventors: Carlo Paglioli, Cisano Bergamasco (IT); Carlo Losa, Cisano Bergamasco (IT)

(73) Assignee: ALUDESIGN S.P.A., Cisano Bergamasco (IT)

( * ) Notice: Subject to any disclaimer, the term of this patent is extended or adjusted under 35 U.S.C. 154(b) by 7 days.

(21) Appl. No.: 16/963,339

(22) PCT Filed: Jan. 24, 2019

(86) PCT No.: PCT/IB2019/050585
§ 371 (c)(1),
(2) Date: Jul. 20, 2020

(87) PCT Pub. No.: WO2019/145883
PCT Pub. Date: Aug. 1, 2019

(65) Prior Publication Data

US 2021/0060362 A1 Mar. 4, 2021

(30) Foreign Application Priority Data

Jan. 25, 2018 (IT) ..... 102018000001896

(51) Int. Cl.
*A62B 1/14* (2006.01)
*A63B 29/02* (2006.01)
*A62B 29/00* (2006.01)

(52) U.S. Cl.
CPC ..... *A62B 1/14* (2013.01); *A63B 29/02* (2013.01)

(58) Field of Classification Search
CPC ..... A62B 1/14; A63B 29/02
See application file for complete search history.

(56) References Cited

U.S. PATENT DOCUMENTS 1,021,986 A * 4/1912 Johnson ..... F16G 11/04 24/136 R
9,227,092 B2 * 1/2016 Chaumontet ..... A62B 1/14
2008/0245611 A1 * 10/2008 Klingler ..... A62B 1/14 182/6

(Continued)

FOREIGN PATENT DOCUMENTS

WO 2011007225 1/2011
WO 2012095737 7/2012

OTHER PUBLICATIONS

International search report and written opinion dated Apr. 16, 2019 for corresponding PCT patent application No. PCT/IB2019/050585.

(Continued)

*Primary Examiner* — David M Upchurch
(74) *Attorney, Agent, or Firm* — Silvia Salvadori

(57) ABSTRACT

A belay device (100) for braking and/or blocking at least one rope (10) including a main body (1) having at least two main walls (2, 3) arranged facing and spaced from one another so that to form a space between them. and at least one friction element or surface (12); said at least one rope (10) being arranged between said braking element (15) and said friction element or surface (12) when said braking element (15) is in said braking/blocking position of the rope.

20 Claims, 10 Drawing Sheets

(56) References Cited

U.S. PATENT DOCUMENTS

Figures 1A, 1B, 1C:
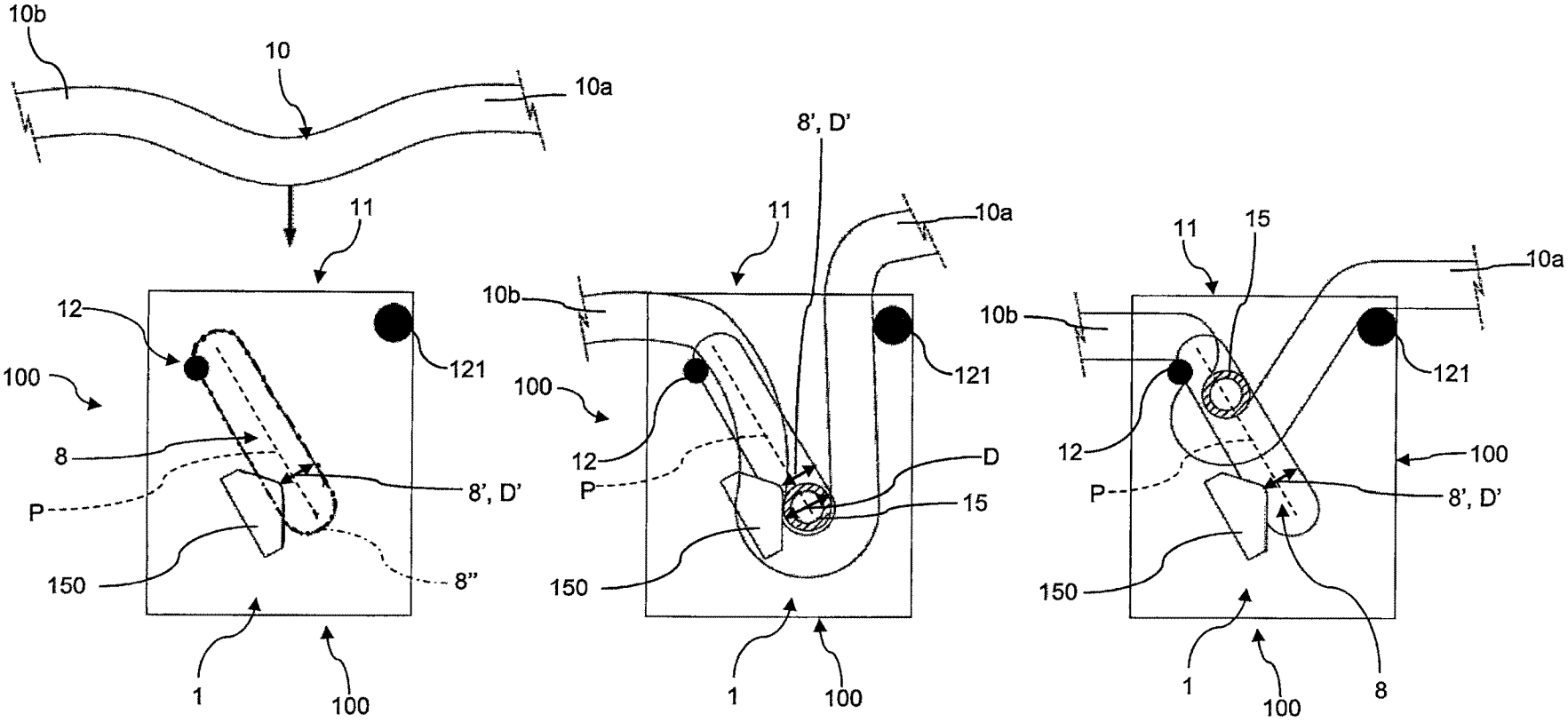

| | | | | |
|---|---|---|---|---|
| 2012/0111665 | A1* | 5/2012 | Paglioli | A63B 29/02 182/5 |
| 2014/0174850 | A1* | 6/2014 | Paglioli | A62B 1/14 182/5 |
| 2016/0130875 | A1* | 5/2016 | Hwang | E06C 7/186 182/5 |

OTHER PUBLICATIONS

Priority Search Report dated Sep. 20, 2018 for Italian priority application No. 102018000001896.

* cited by examiner

BELAY DEVICE

This application is a U.S. national stage of PCT/IB2019/050585 filed on 24 Jan. 2019, which claims priority to and the benefit of Italian Application No. 102018000001896 filed on 25 Jan. 2018 the contents of which are incorporated herein by reference in their entireties.

FIELD OF THE INVENTION

The present invention concerns a belay device for adjusting, braking and/or blocking at least one rope that is inserted and that runs inside the device.

The term belay device refers to a safety device mainly used in climbing equipment, but also for professional use for works in altitude, by means of which a first climber controls and brakes and/or blocks the safety rope used to belay a second climber, in addition to allowing self-belaying when descending on a doubled and simple rope.

It should immediately be noted that the braking and/or blocking of the rope (or more simply the braking/blocking of the rope) will be referred to hereinafter by denoting that the belay device of the invention can determine the braking of the rope, or the blocking of the rope, or also the combination of a braking of the rope that ultimately leads to the blocking of the rope itself.

DESCRIPTION OF THE KNOWN ART

These devices, known in the field of mountaineering under the term "belay device or safety device," can be used both for outdoor and indoor climbing, for example in training gyms, and allow, in case of emergency, to ensure the safety of one or more climbers by blocking the safety rope or ropes to which they are belayed to, therefore preventing them from falling.

These devices are normally used to belay a climber (the leader or first on the rope), intent on climbing a face, to a companion on the ground, named "belayer" in jargon, who prevents the climber he is belaying from free falling by means of the belay device whenever, during the climb, an error is made with the consequent loss of a secure grip on the grips.

This technique is known as "belaying the first on the rope," wherein the first climber getting ready to climb is assisted and belayed to a companion on the ground, precisely the belayer, by means of the belay device, which, in case of emergency, allows to brake and/or block the safety rope constrained to the climber, and which the latter constrains to one or more rings (return points or belaying points) present on the face as he gradually climbs up. The belaying of the leader can occur by means of one or two ropes that are passed inside the belay device.

Moreover, as mentioned above, other uses of belay devices, which exploit the possibility to block/brake the safety rope in case of emergency, are known, in particular, the belayer can also carry out his function when he is on the face.

For example, the devices can be used to belay one or more companions that must climb, this technique is known as "belaying the followers or seconds on the rope". In these cases, a first climber on the face to be climbed acts as the belayer and controls the safety rope to which a second climber climbing the face underneath him is belayed by means of the belay device. If the second climber loses the hold, the belay device constrained to the climber at a higher point, or fixed at an anchoring point on the face, allows to brake/block the safety rope and therefore prevents the companion from falling. As mentioned, two followers can be belayed to the rope too, each of whom is constrained to his own safety rope, which is passed inside the belay device.

Moreover, in addition to belaying the first on the rope and one or two seconds, these devices are known to be used as descenders (descender devices or rappelling devices), i.e. to go down a face that was previously climbed. In fact, the climber carrying the constrained device exploits the ability of belay device to brake/block the rope running inside it and therefore to adjust, possibly by suitable means provided on the device or simply manually, the descent speed by modifying the friction that the device exerts on the rope. Moreover, following the fall of the belayed climber or climbers, both in case of the first belayed climber and of one or two second belayed climbers, the devices currently available allow to unblock the device from the position in which the rope is braked/blocked and allow the controlled descent or coming down of the climber to the ground or up to a secure point on the face.

The belay devices of the known art adjust the running of the rope and brake/block it by exerting a braking action, typically by generating friction on the safety rope. By doing so, it is possible to adjust the running of the rope, to slow it down (and therefore to brake) or to block it, therefore preventing the climber that needs to be belayed from falling.

Devices of the manual type or of the semiautomatic type are known, the latter automatically snap shut to the emergency position in which they brake/block the rope in case of emergency and therefore following the sudden tensioning of the rope due to the fall of the climber.

Instead, in case of fall with manual devices, the person who constrained the device to himself to belay the companion during the climb must manually move the safety rope in the position in which the device can slow down the running and/or determine the blocking thereof.

The patent application WO2011/007225 in the name of the same Applicant of the present application describes a belay device marketed under the name Click-UP, which comprises a main body formed by two plates (which form the walls of the body of the device) constrained to one another according to two planes, preferably parallel, and by an opening in the body of the device allowing to hooking a braking/blocking karabiner of the rope, which is movable inside the opening itself.

The karabiner allows to constrain the device to the harness of the user, or belayer.

Whenever needed, and therefore if the belayed climber falls, the tension to which the rope constrained to the falling climber is subjected, determines the relative displacement of the karabiner inside the opening provided on the device, from the non-blocking position of the rope, which is the normal use condition, to the emergency position in which the rope is braked and/or blocked between the karabiner and a countering or friction element.

This device allows to constrain the first on the rope, as well as one or two seconds, in an effective and simple way, simply by constraining the karabiner to a hooking point fixed on the face instead of to the harness of the belayer. When the device is constrained to the fixed hooking point on the face by means of the karabiner, its function is substantially similar to that of the use for belaying the first on the rope. In fact, the braking and/or blocking of the rope occurs by means of the relative displacement of the karabiner inside the opening provided in the body of the device, towards the position in which the rope is braked and/or blocked between the karabiner and a countering or friction element.

The belay device described in WO2011/007225 further comprises a movable lever rotatably constrained in the space between the two plates or walls of the body of the device and which is preloaded by means of a spring.

The lever acts on the rope inserted in the device and therefore in contact with the latter. The lever cooperates with a protruding portion, or tooth, of the profile of the opening in the plate of the device, to prevent the displacement of the karabiner hooked onto the body of the device from the non-blocking position of the rope towards the braking/blocking position of the rope.

As mentioned, if the person tied to the end of the rope falls, the user of the device or belayer stresses the free end of the rope (entering the device) to hold back this fall. This causes the rope to be tension stressed, determining the relative forward displacement of the karabiner, relatively to the device body, and to overcome the resistance provided by the preloaded lever by means of contact with the rope.

Although functional and effective, this operating mode requires that the position of the lever, its preload and the position of a tooth or protruding portion of the profile of the opening of the device are sized and relatively arranged so that the displacement of the karabiner can also be effectively prevented if ropes of different dimensions are used.

In fact, as mentioned, the rope inserted in the device contacts the lever. In other words, the rope is interposed between the movable lever and the karabiner. Consequently, in order to overcome the preload of the spring provided with the lever, the relative sensitivity of actuation will differ depending on the dimensions (and in particular of the diameter) of the rope used.

This activation difference depends on the type of rope used and can involve, in case of falls and relative actuation of the device, an increase, although limited, in the length of the fall for the person falling.

Moreover, a further undesired effect that can occur, especially when using ropes of small dimensions, is that the karabiner could easily move to the braking/blocking position of the rope, and therefore lead to undesired braking/blocking thereof, even when normally using the rope to feed it to the belayed climber.

Contrarily, by using ropes with greater diameter, especially if the ends or extremities of the rope coming in or out of the device are maintained parallel during use, the force necessary for actuating the device and therefore the movement of the karabiner in the braking/blocking position of the rope is much stronger than what required with ropes of smaller diameter, thus making the system less effective and less sensitive to low falls, for example in case of slipping on a tilted plane.

An object of the present invention is to improve the device object of WO2011/007225 by overcoming the drawbacks described above.

In particular, an object of the present invention is to provide a safe and reliable belay device independently from the dimensions of rope used.

SUMMARY OF THE INVENTION

These and other objects are achieved by the belay device according to claim 1. Further features/aspects of the device are described in the dependent claims.

The belay device for braking and/or blocking at least one rope according to the present invention, comprises a main body having at least two main walls (preferably substantially flat) arranged facing and spaced from one another so that to form a space between them. At least one rope is inserted inside the body of the device in the space between the two main walls, by passing through an opening that allows access to the space between the two main walls. Each main wall further comprises an opening at least partially defining a movement path for at least one braking element of the rope which is movable in the opening between at least one non-blocking position of the rope and at least one braking/blocking position of the rope.

It should be noted that the expression "movable in the opening" is used here and hereinafter to denote the relative movement (or relative displacement) between the braking element and the body of the device and therefore to denote that the braking element is movable with respect to the opening. In other words, this expression means that the braking element is arranged in the opening, for example hooked to the opening, so that there is motion or relative displacement between the braking element and the body of the device, and in particular between the braking element and the opening of the body of the device. More in detail, at least one between the braking element and the body of the device is movable so that the relative position between these two elements can change and therefore the braking element can reach the at least one non-blocking position and the at least one braking/blocking position of the movement path. For simplicity, the expression movement, or displacement, of the braking element in the opening will hereinafter be referred to as the relative movement, or displacement, between the braking element and the body of the device.

Furthermore, for simplicity, a "braking element" will hereinafter be referred to as an element apt to determine the braking and/or blocking of the rope, as will be seen in detail, when this element is arranged in the braking/blocking position of the rope.

The device further comprises at least one friction element, or surface, that cooperates with the braking element to determine the braking and/or blocking of the rope. In fact, the rope is arranged (and in particular compressed) between the braking element and the friction element or surface when the braking element is in the braking/blocking position of the rope.

According to the invention, the device further comprises at least one retaining element of the braking element in the non-blocking position of the rope along the movement path.

The retaining element is configured to hold directly, and reversibly, the braking element in the at least one non-blocking position of the rope along the movement path.

It should also be noted that the term "directly" is herein used to denote that there is a direct interaction between the retaining element and the braking element, and that there is therefore no interposition of the rope in the interaction between the braking element and the retaining element (as occurs, for example in WO2011/007225).

As will be better seen hereunder, the presence of a braking element, for example provided in the form of a sleeve, or similar movable element in the opening of the device, that in turn allows to constrain or hook a second element thereto, such as a karabiner or ring for example, falls within the scope of protection of the present invention.

Advantageously, unlike known solutions, as for example the one described in WO2011/007225, the retaining element directly holds the braking element movable inside the opening and a lever arranged in contact with the rope inserted inside the device is no longer present. As a result, the braking element, such as for example a karabiner, can be effectively held in the non-blocking position of the rope given that there is a direct interaction with the retaining element, and no longer by means of the interposition of the rope, such as occurs, for example, in WO2011/007225.

According to an aspect of the invention, the expression "directly holding the braking element" means that the retaining element transmits to, and/or generates onto, the braking element a resistive force (and in general a resistance) that counters the movement of the braking element at least from said at least one non-blocking position of the rope towards the at least one braking/blocking position of the rope.

In other words, according to the present invention, the retaining element transmits and/or generates a resistive force (and in general a resistance) that impedes the direct movement of the braking element, i.e. without transmitting, and/or generating, the resistive force that counters the movement of the braking element to/onto the braking element by means of interposing the rope, and therefore transferred to the braking element through the rope installed in the device.

In use, according to an aspect of the invention, the braking element is subjected to forces (for example due to the tensioning of the rope, both in case of normal use when the rope is passed to feed rope to the belayed climber and when the belayed climber falls and a greater tensioning of the rope is determined) that tend to displace it with respect to the body of the device from the non-blocking position of the rope towards the braking/blocking position of the rope. As mentioned, this refers to the relative displacement between the braking element and the body of the device. The retaining element contrasts these forces by holding the braking element in the non-blocking position, and in particular, as mentioned, transmits and/or generates a resistive force to this relative displacement which tends to move the braking element towards the braking/blocking position of the rope.

This way, the movement of the braking element from the non-blocking position of the rope (and therefore of normal use of the device in which the rope can freely run inside thereof) towards the braking/blocking position of the rope can be temporarily impeded in a safe and effective way, and especially independently of the diameter of the rope inserted in the device.

Advantageously, the device according to the invention allows to obtain an amplified operability in feeding and retrieving the rope, from and towards the belayed person upstream, with a relative increase in his safety.

Moreover, the solution proposed allows a particular sensibility of actuation and trigger in case of fall, i.e. of a sudden tension stress of the rope.

As mentioned, according to an aspect of the present invention, the retaining element reversibly holds the braking element. In other words, the retention is temporary and, in general, the retention exerted by the retaining element is of the reversible type and therefore releasable.

More in detail, according to an aspect of the invention, the retaining element holds the braking element until the force exerted by the braking element onto the retaining element, for example caused by the tensioning of the rope that is transferred to the braking element, overcomes a certain predefined threshold.

This threshold, or threshold value, can for example substantially correspond to the maximum resistive force value transmitted and/or generated by the retaining element. As a result, when this threshold is overcome, the resistance of the retaining element is overcome and the relative movement between the braking element and the body of the device causes the braking element to move from the non-blocking position towards the braking/blocking position, or vice-versa.

Advantageously, this threshold value is chosen so that to allow the effective retention of the braking element in the non-blocking position during the normal use of the device (for example when needing to feed rope to the belayed climber by making the rope run freely inside the device) and so that to determine the displacement towards the braking/blocking position when the rope is tensioned, for example following the fall of the belayed climber.

According to an aspect of the invention, this threshold value for which the braking element is no longer held in non-blocking position and can therefore move towards the braking/blocking position of the rope, can be chosen, for example, by means of the geometric shape and/or dimensions of the retaining element and/or characteristics of the material with which the retaining element is made and/or of suitable preloading means of the retaining element.

According to an advantageous aspect of the present invention, the retaining element is arranged so that to intercept and therefore come into contact with the braking element, which is movable in the opening. In other words, according to an aspect of the present invention, the retaining element is arranged into contact with the braking element to impede its movement at least from the non-blocking position of the rope towards the braking/blocking position of the rope along the movement path along the profile P.

Advantageously, the contact of the retaining element with the braking element allows to transmit to the braking element the resistive force countering the relative movement of the braking element towards the braking/blocking position of the rope, the braking element is therefore held in the non-blocking position of the rope by the retaining element.

According to an aspect of the invention, the retaining element extends inside the profile of the opening to contact the braking element, thus impeding its movement at least from the non-blocking position of the rope towards the braking/blocking position of the rope along the movement path.

Advantageously, the extension of the retaining element inside the profile of the opening causes the retaining element to interfere with the movement of the braking element inside the opening, and therefore so that to be incident to the movement path of the braking element. This way, it is possible to obtain the contact of at least part of the retaining element with the braking element, therefore determining the temporary impediment of the movement, at least from the non-blocking position of the rope towards the braking/blocking position of the rope.

According to an aspect of the present invention, the retaining element forms a narrow portion of the opening in which the braking element is movable.

Advantageously, the retaining element determines a reduction of the dimensions of the opening, thus forming a narrow portion for the passage of the braking element. This narrow portion has reduced dimensions with respect to other parts/areas of the opening in which the retaining element is not present.

This way, it is possible to effectively and directly control the movement of the braking element along the movement path of the opening.

In fact, as mentioned, given there is contact between the braking element and the retaining element, and no longer the interposition of the rope as in WO2011/007225, the operation is independent of the diameter of the rope used.

According to a further aspect of the present invention, the retaining element holds the braking element in non-blocking position of the rope, generating a force resistant to the displacement of the braking element towards the blocking position, for example such force can be a magnetic force.

According to possible embodiments, this magnetic force is exerted for example by a retaining element comprising a magnet adapted to attract a braking element towards itself, for example made of a material that is attracted by the magnetic force generated, as for example a ferromagnetic material. For example, a braking element made of iron, for example an iron karabiner, can be used.

The magnetic force generated by the retaining element comprises a magnet attracting towards itself the braking element and therefore generates a resistance against its moving away and therefore against the movement from the non-blocking position of the rope towards the braking/blocking position of the rope.

Advantageously, also according to this aspect of the invention, the retaining element directly holds the braking element in the non-blocking position of the rope, by generating the magnetic force that counters the movement of the braking element. Moreover, also according to this aspect, the retention is reversible, in fact, when the braking element is biased by the rope with a force greater than the force generated (for example the magnetic force) by the retaining element onto the braking element, the latter will be able to move towards the braking/blocking position of the rope.

It should immediately be noted that the possible embodiment in which the retaining element contacts the braking element, and therefore preferably transmits a resistive force countering the movement of the braking element, can be alternative, or used in combination, to the possible embodiment in which the retaining element generates a resistive force, for example a magnetic force, countering the displacement of the braking element at least from the non-blocking position towards the braking/blocking position of the rope.

In other words, according to an aspect of the present invention, the retaining element is configured to directly, and reversibly, hold the braking element in at least one non-blocking position of the rope along the movement path and, preferably, the retaining element is in contact with, and/or generating a resistive force onto (for example a magnetic force) the braking element so that to counter the movement of the braking element at least from the non-blocking position of the rope towards the braking/blocking position of the rope.

BREW DESCRIPTION OF THE FIGURES

Figure 2B:
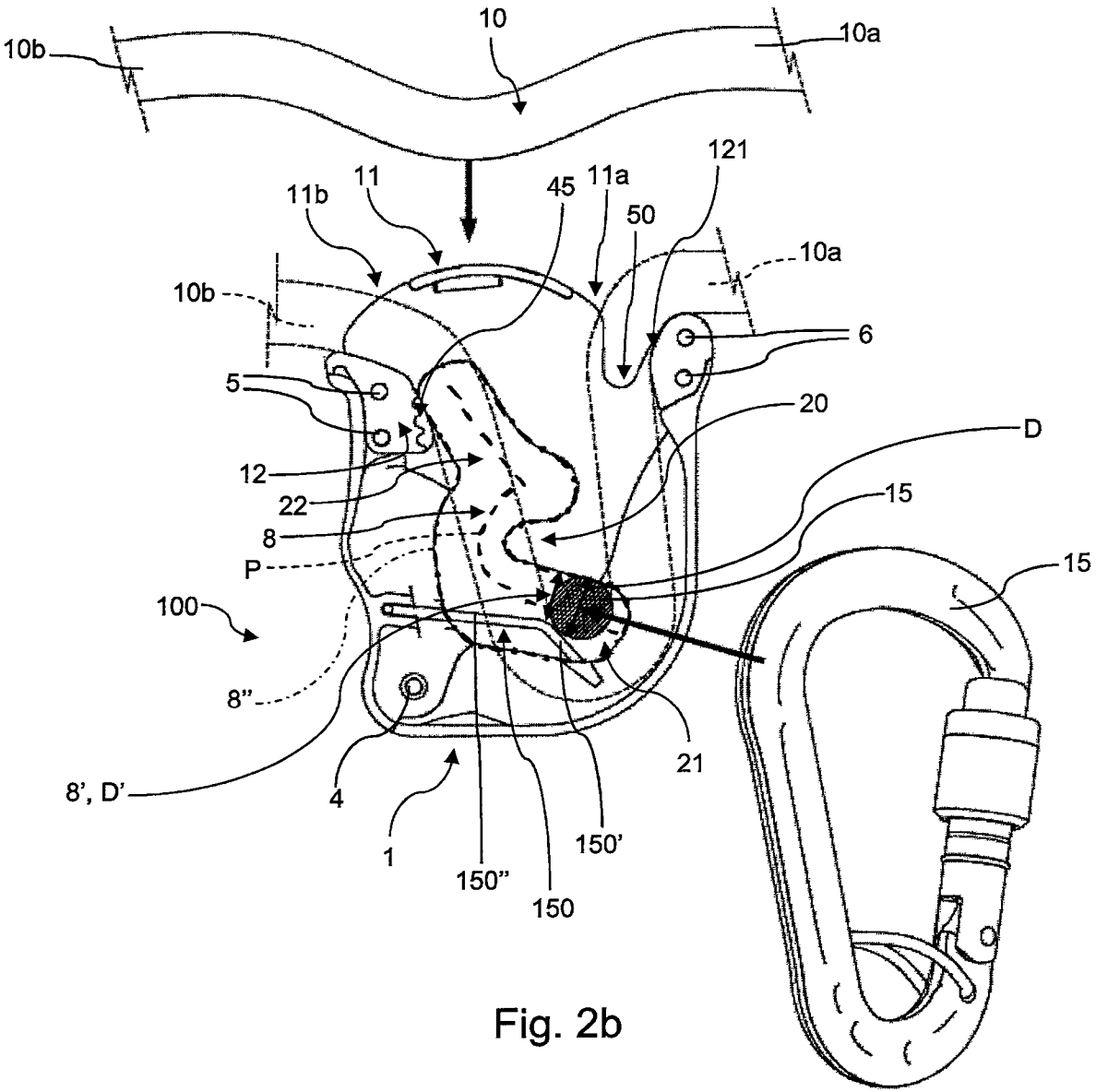
Figure 2A:
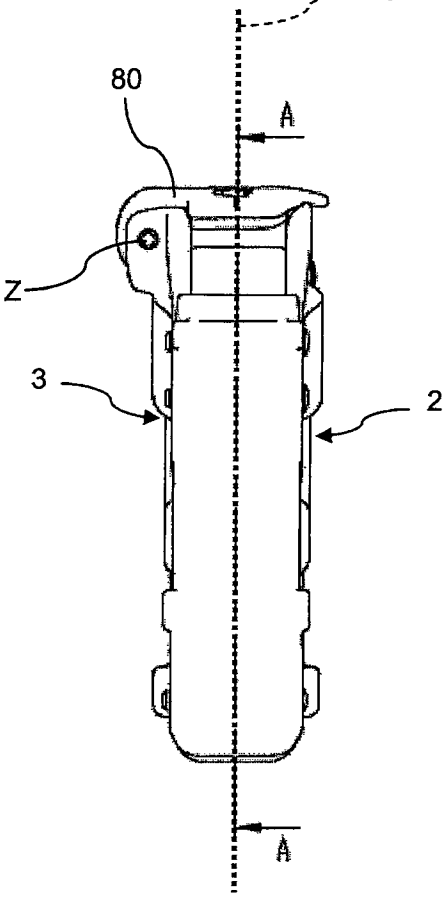
Figure 3B:
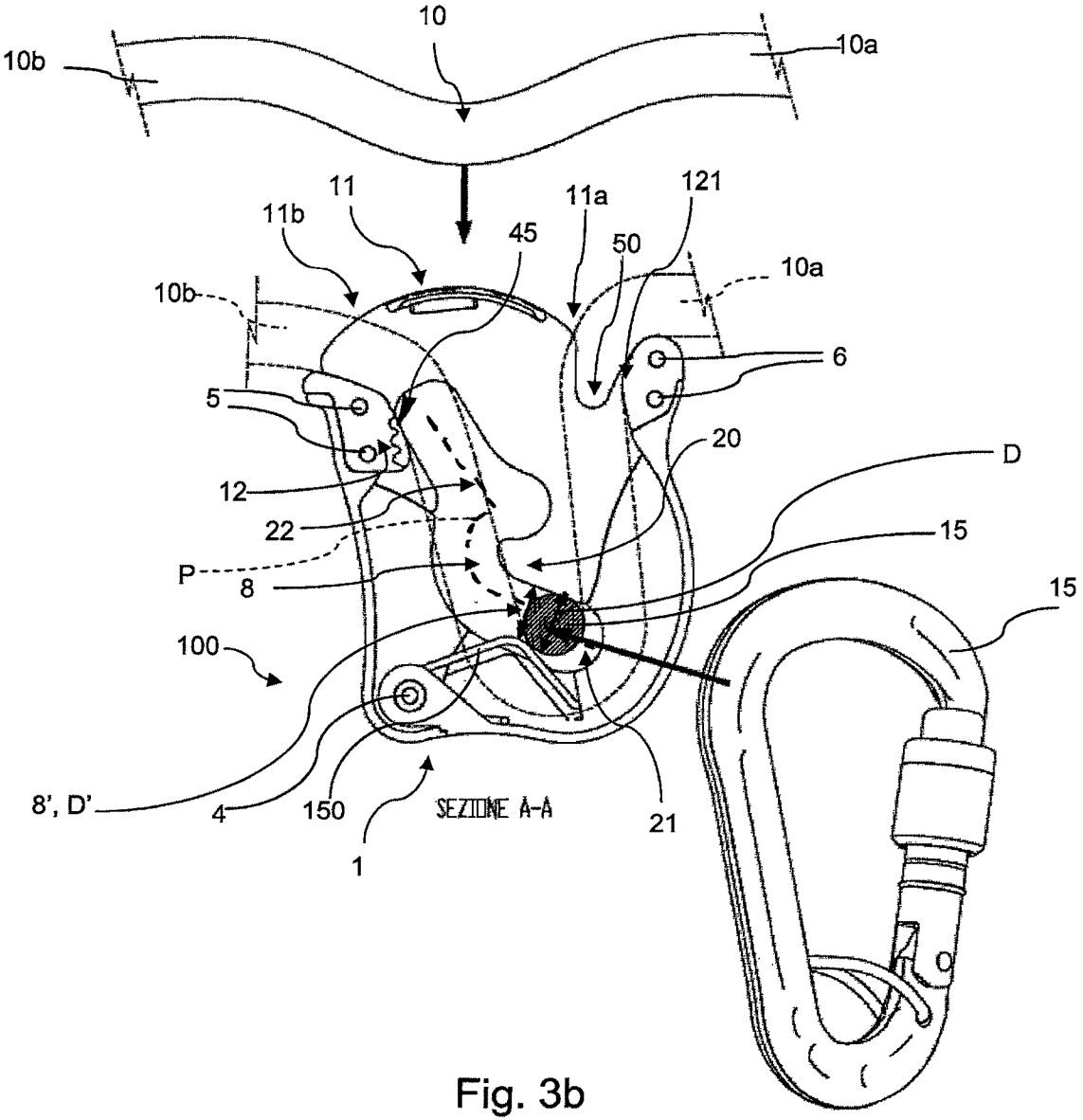
Figure 3A:
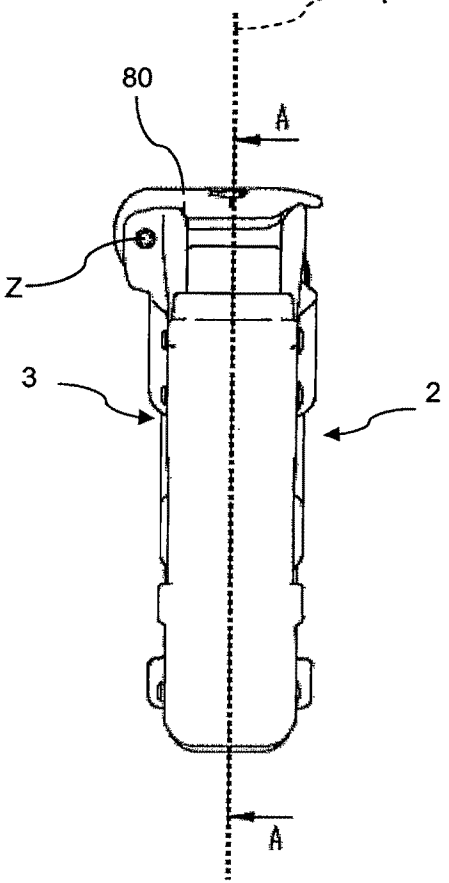
Figure 4B:
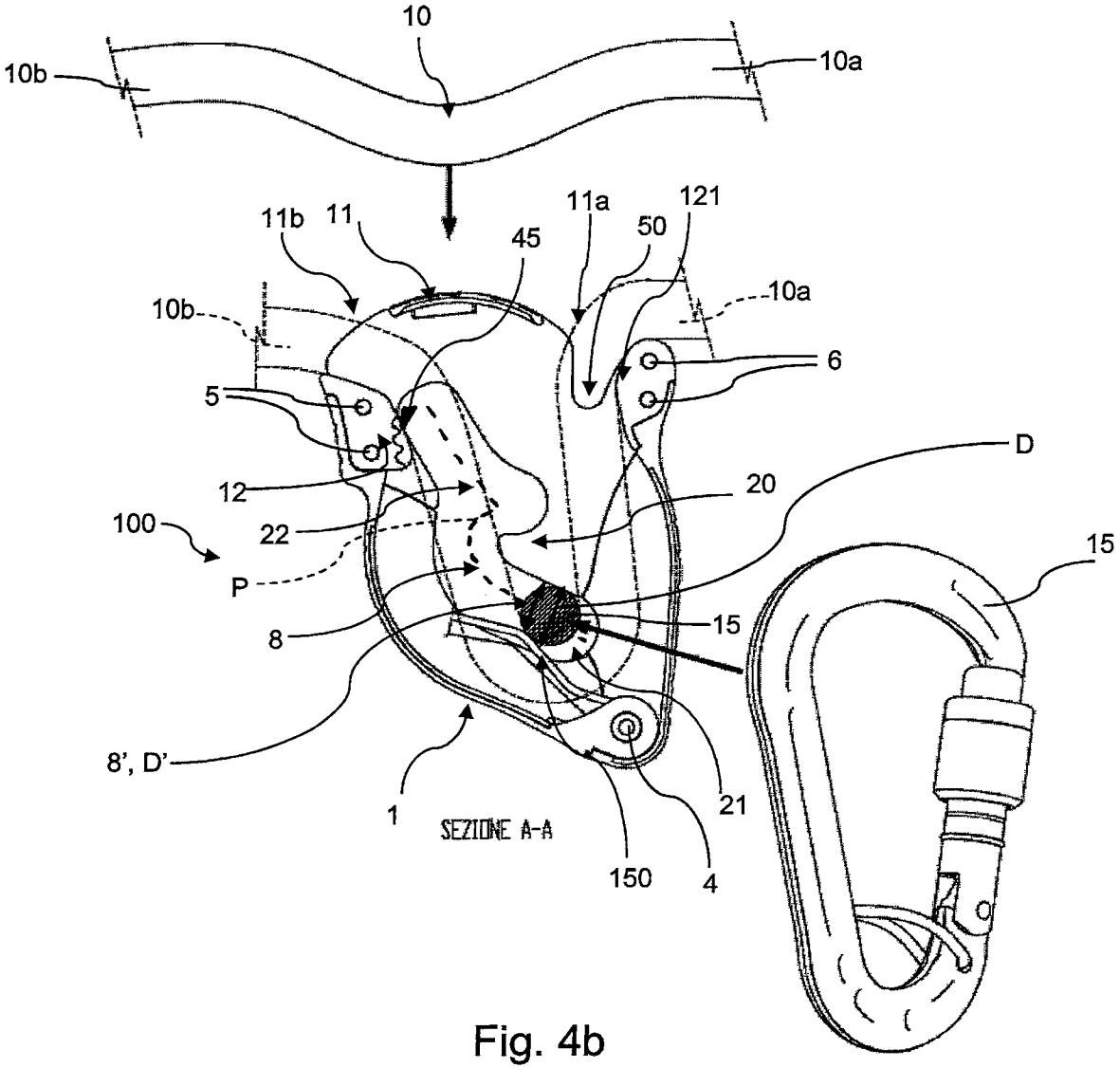
Figure 4A:
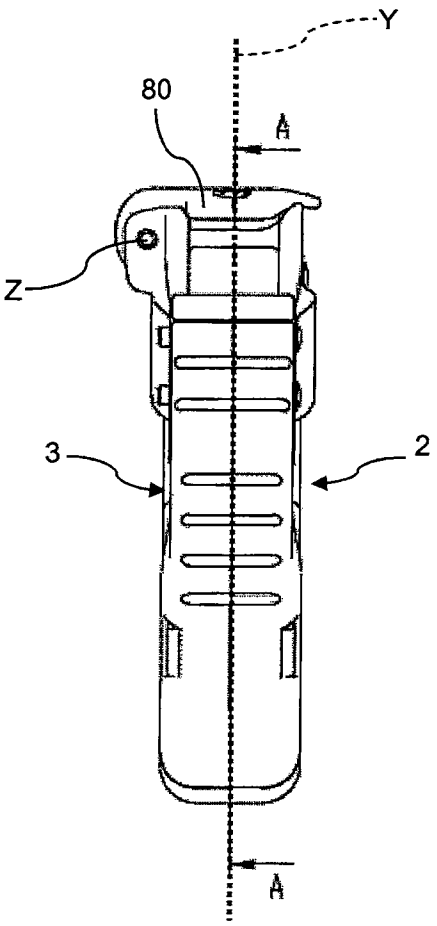
Figure 5B:
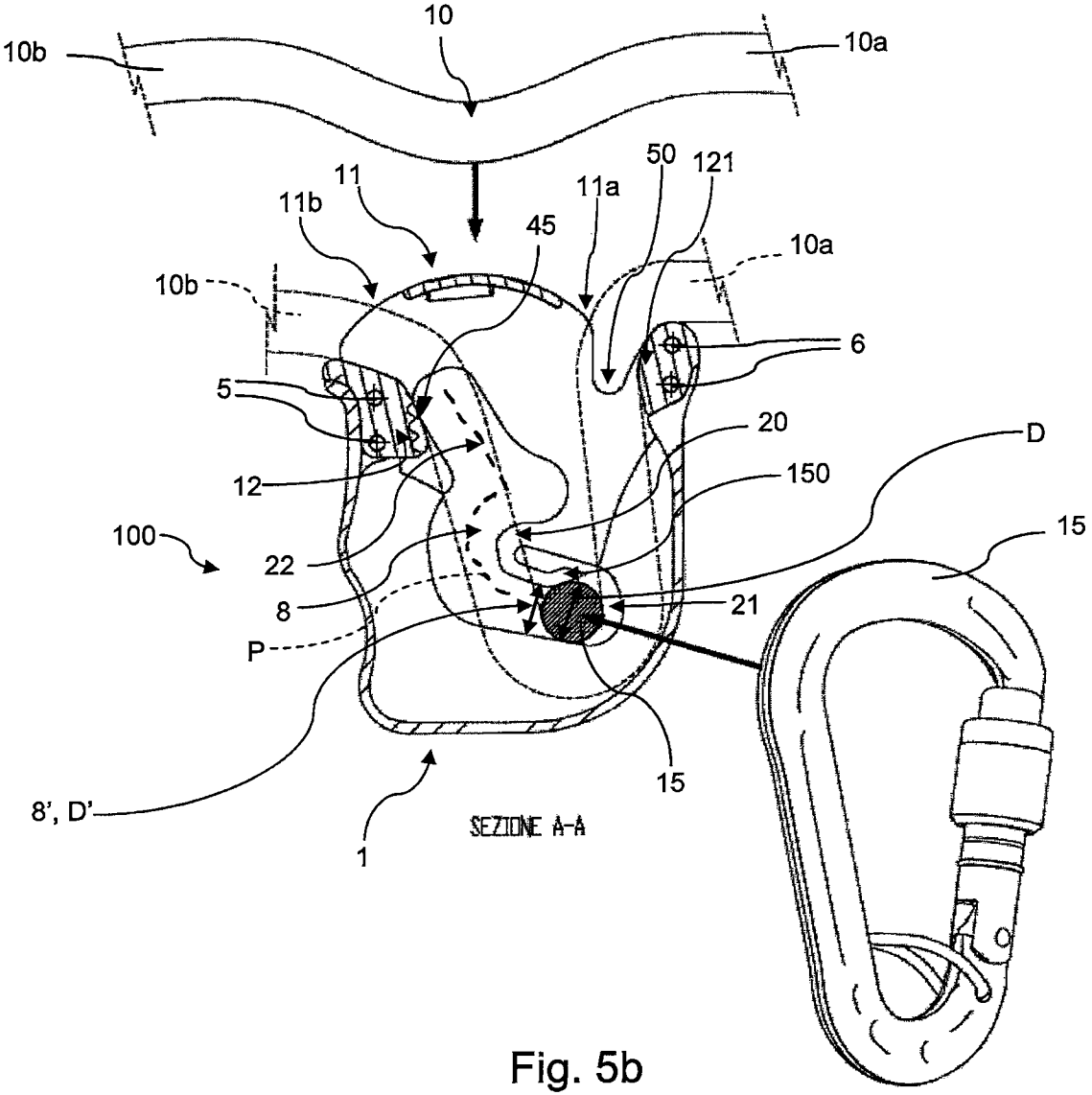
Figure 5A:
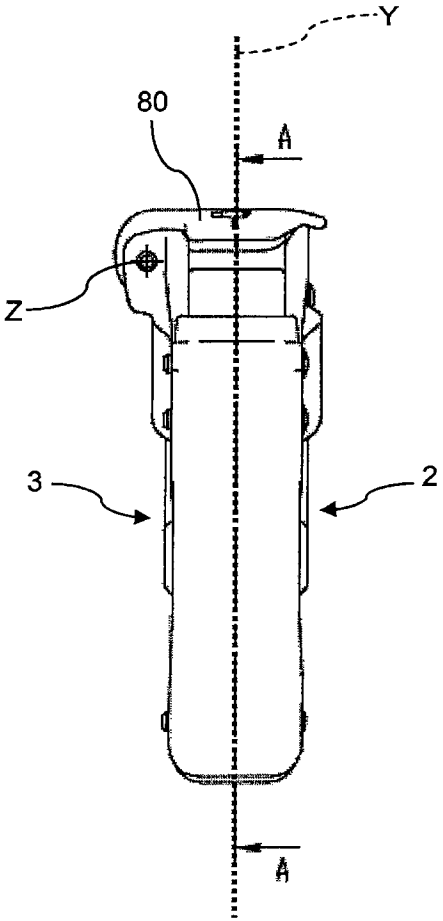
Figure 6B:
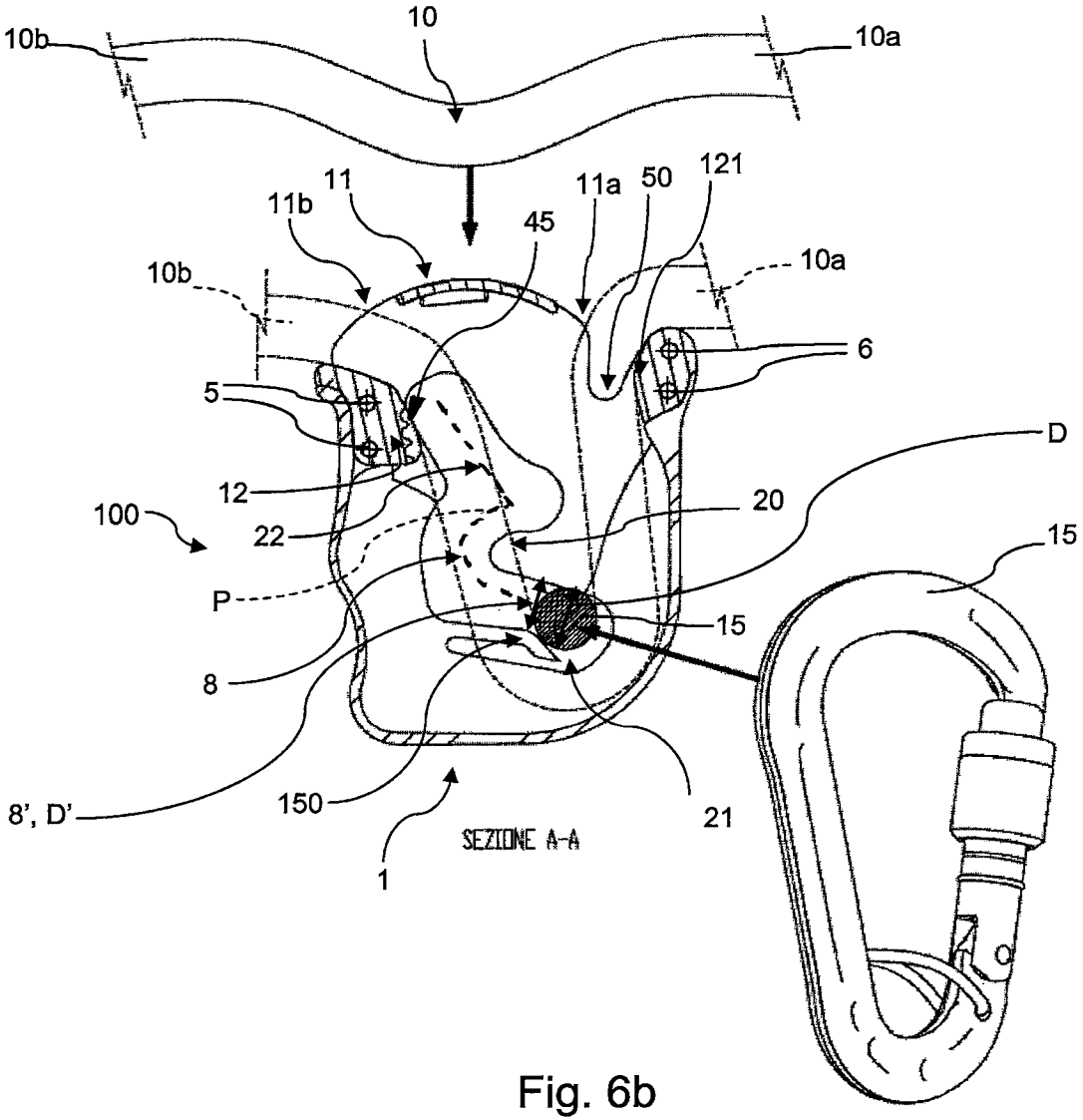
Figure 6A:
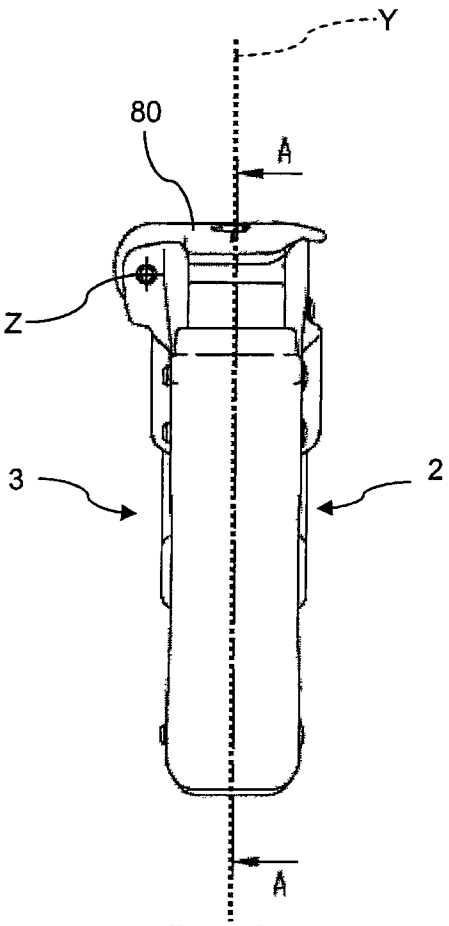
Figure 7B:
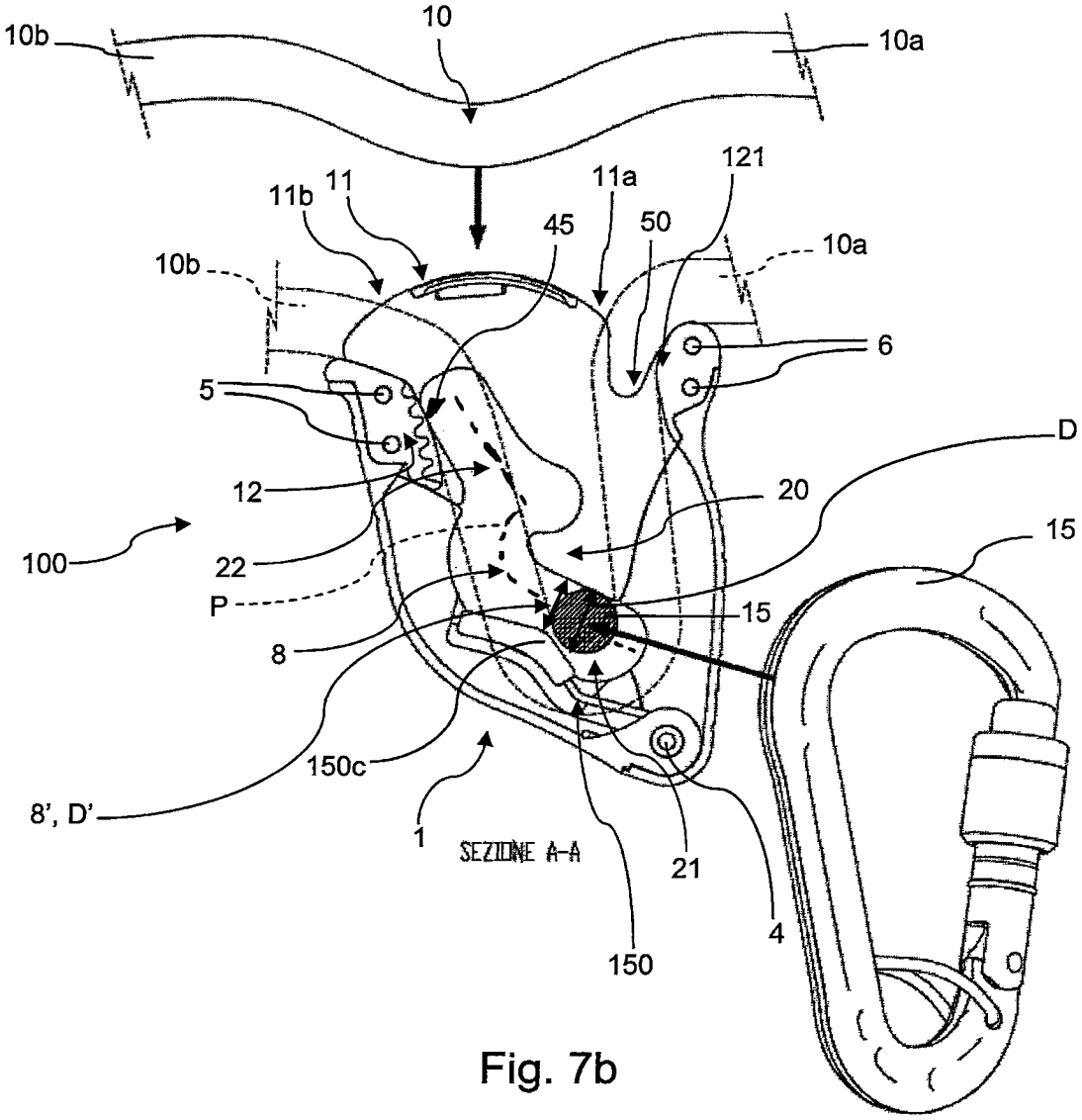
Figure 7A:
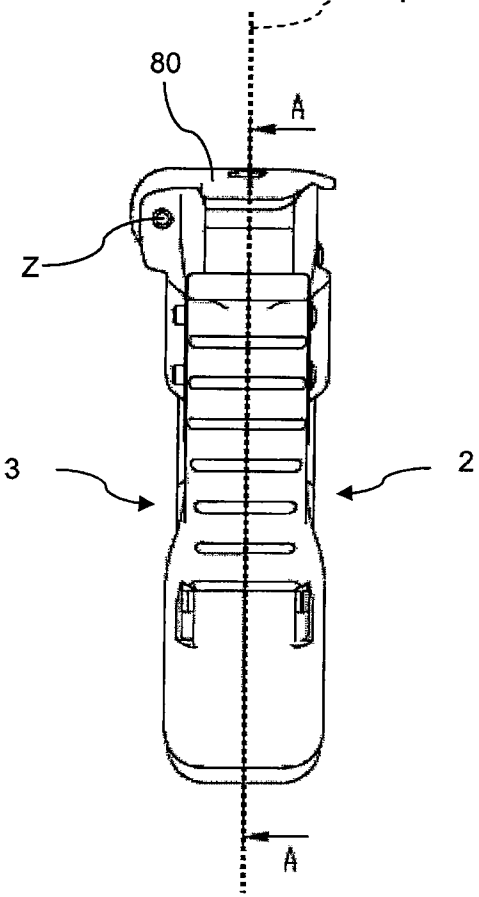
Figure 8B:
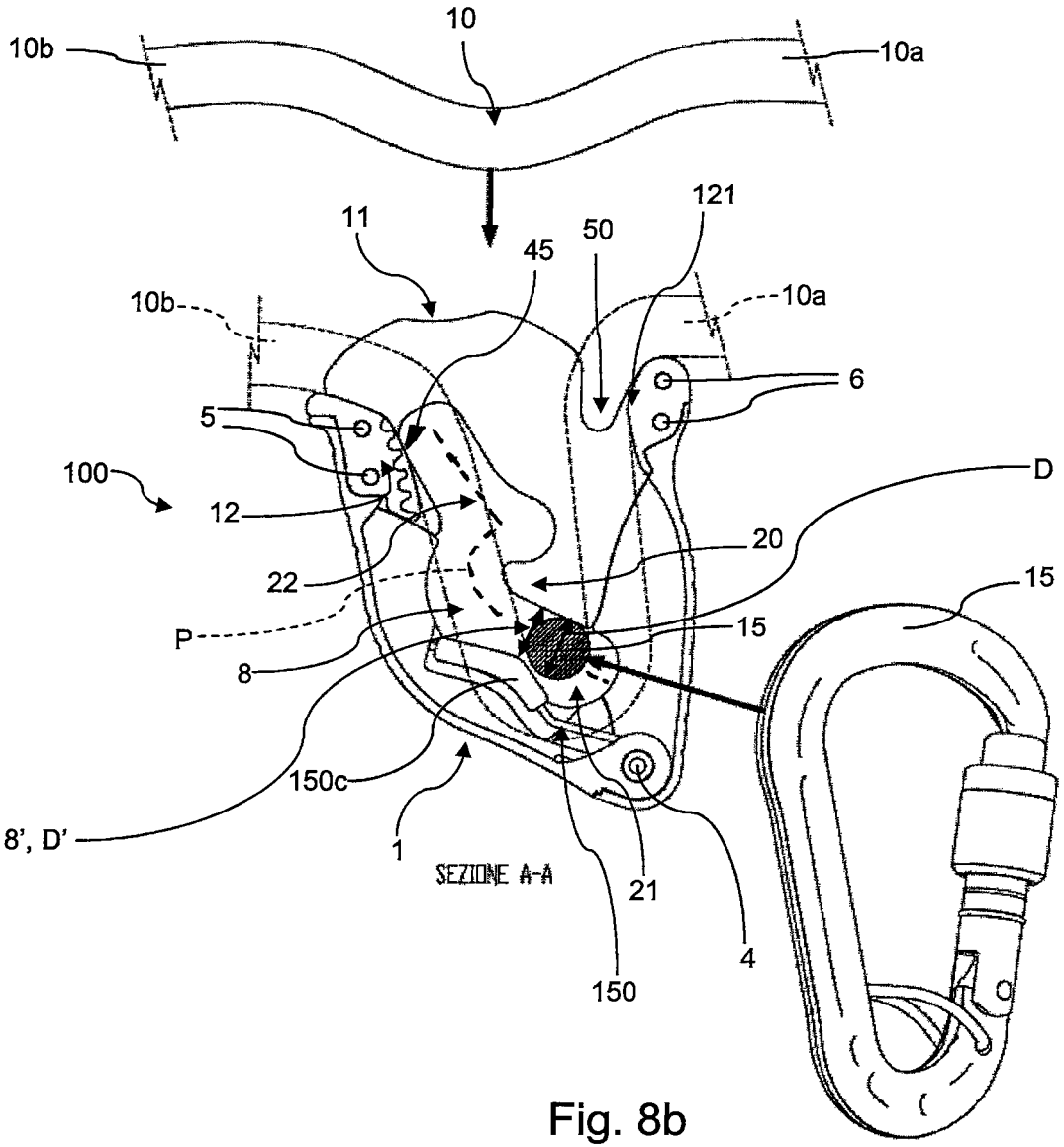
Figure 8A:
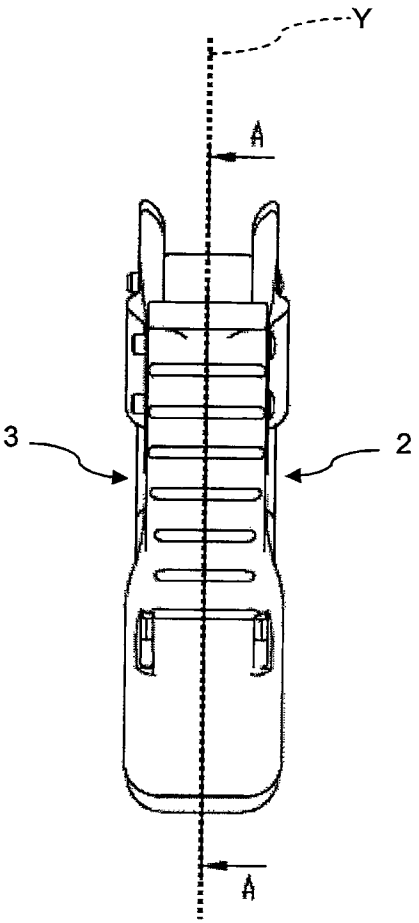
Figure 9B:
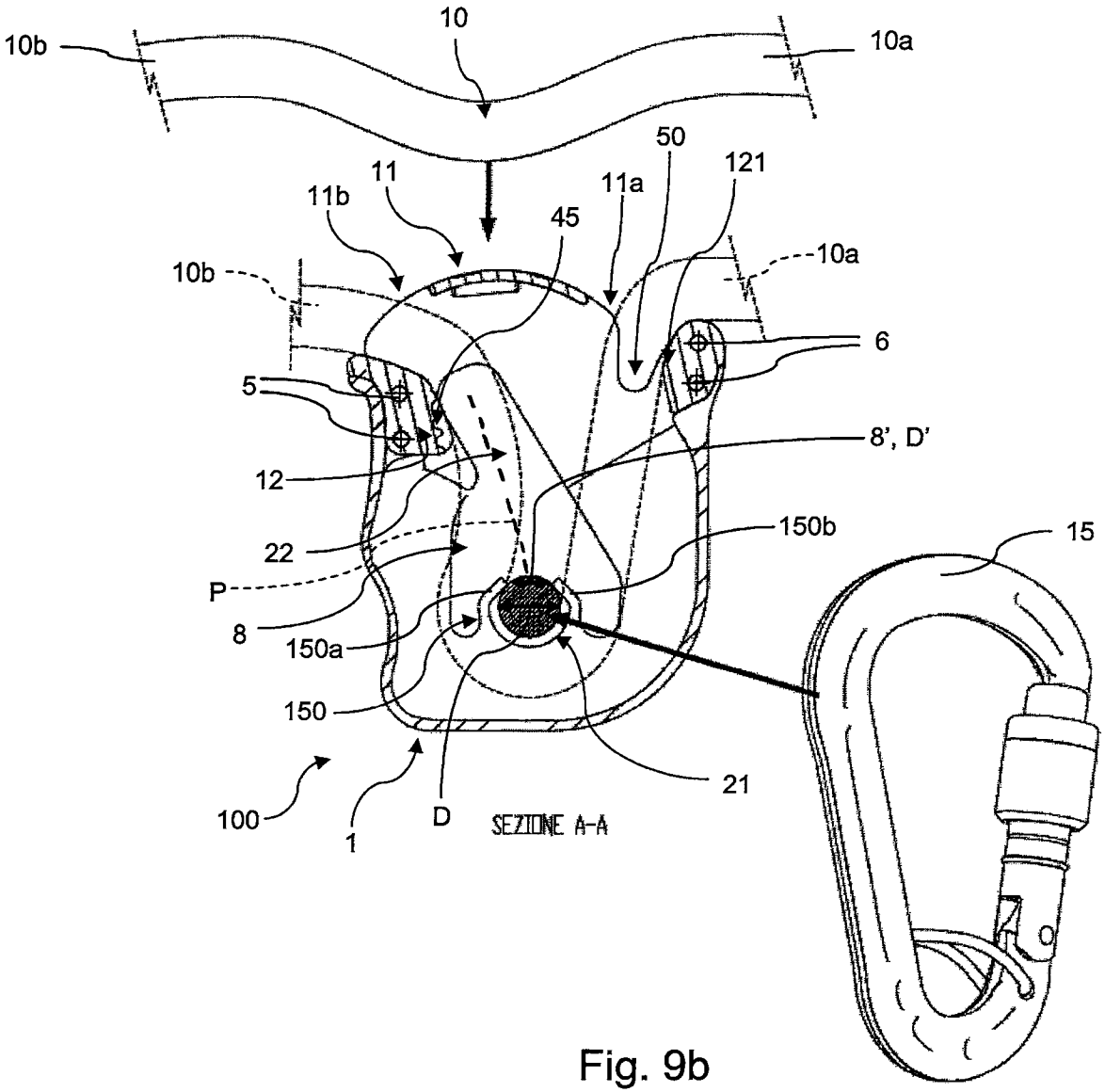
Figure 9A:
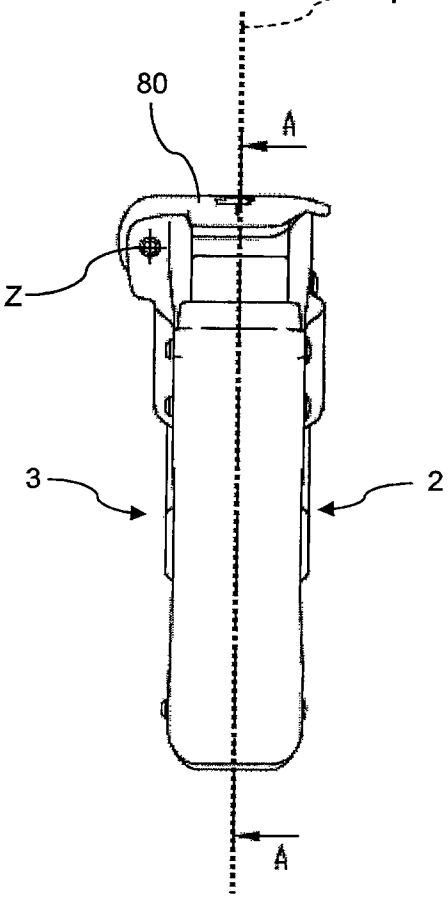
Figure 10B:
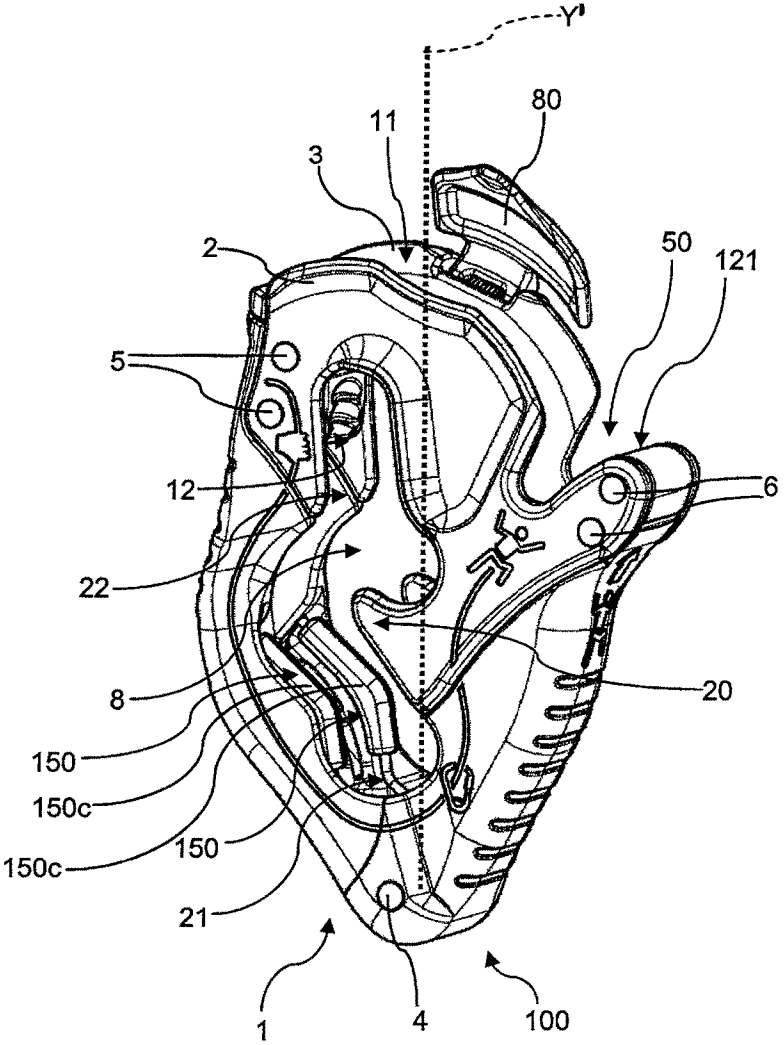
Figure 10A:
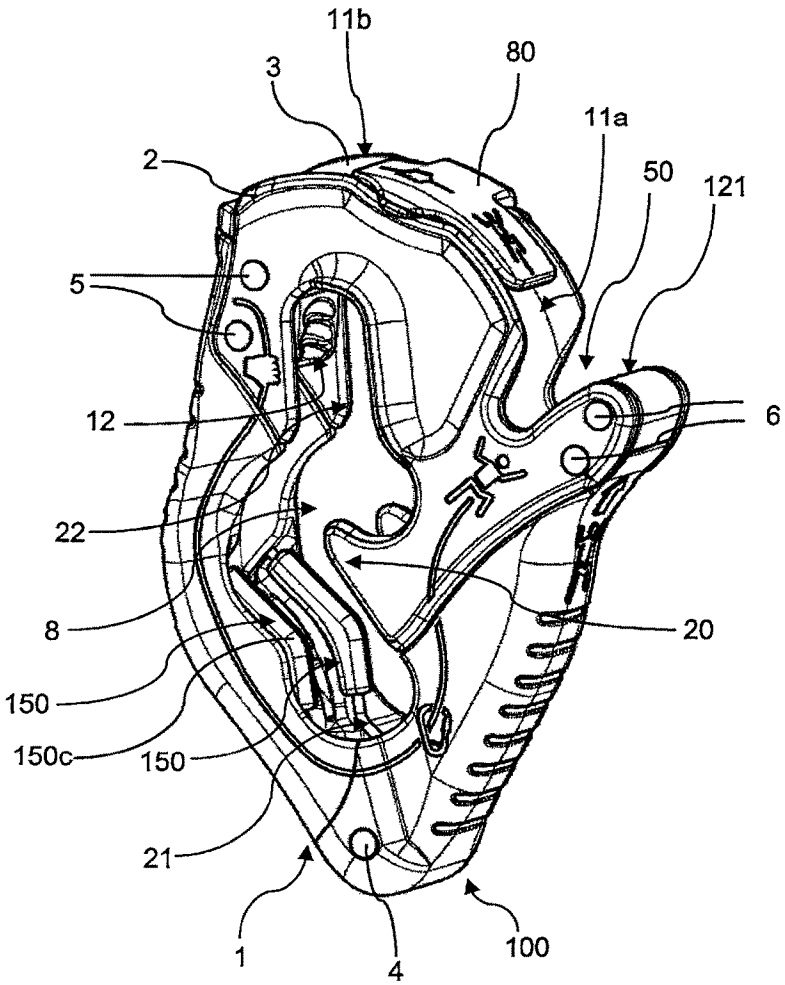

Further features and advantages of the present invention will become clearer in the following description, which was made by way of example with reference to the accompanying figures, in which:

FIGS. 1*a*, 1*b* and 1*c* schematically show the operations of a possible embodiment of the device according to the present invention, wherein in FIG. 1*a*, the rope is still not inserted in the body of the device, in FIG. 1*b*, the rope was inserted in the device and the braking element is arranged in the opening and is in a non-blocking position of the rope; in FIG. 1*c*, the braking element is in a braking/blocking position of the rope;

FIGS. 2*a*-2*b* show a possible embodiment of the device according to the present invention, respectively in a side and sectional view according to the plane A-A; the retaining element comprises a piano wire having both sides constrained to the body of the device;

FIGS. 3*a*-3*b* show a possible embodiment of the device according to the present invention, respectively in a side and sectional view according to the plane A-A; the retaining element comprises a spring constrained at the lower left portion of the device and having a free end;

FIGS. 4*a*-4*b* show a possible embodiment of the device according to the present invention, respectively in a side and sectional view according to the plane A-A; the retaining element comprises a spring constrained at the lower right portion of the device and having a free end;

FIGS. 5*a*-5*b* show a possible embodiment of the device according to the present invention, respectively in a side and sectional view according to the plane A-A; the retaining element is made in one piece with the body of the device and comprises a free end;

FIGS. 6*a*-6*b* show a possible embodiment of the device according to FIGS. 5*a* and 5*b* in which the position of the retaining element is different;

FIGS. 7*a*-7*b* show a possible embodiment of the device according to the present invention, respectively in a side and sectional view according to the plane A-A; the retaining element comprises a spring constrained at the lower right portion of the device and having a free end in addition to being provided with a coating material with low friction coefficient;

FIGS. 8*a*-8*b* show a possible embodiment of the device according to FIGS. 7*a*-7*b* in which the device is not provided with a movable lid for partially closing the opening for the coming in and out of the rope;

FIGS. 9*a*-9*b* show a further possible embodiment of the device according to the present invention in which the retaining element is made in one piece with at least part of the body of the device;

FIGS. 10*a* and 10*b* are perspective views of a possible embodiment of the belay device according to FIGS. 7*a*, 7*b*, in which the braking element and the rope are not shown, wherein the movable lid is respectively shown in an operative position in which it at least partially obstructs the passage opening for the coming in and out of the rope, and in a non-operative position in which it does not obstruct this opening.

DESCRIPTION OF SOME EMBODIMENTS

With reference to the accompanying figures, some possible embodiments of the belay device 100 according to the present invention will be described. It should immediately be noted that in the accompanying figures, similar elements of the various embodiments will be denoted by the same numerical references.

FIGS. 1*a*-1*c* schematically show a possible general embodiment of the device according to the present invention and its operation mode. That which is described with reference to the embodiment shown in FIGS. 1*a*-1*c* can be equally applied to other possible embodiments shown in the other accompanying FIGS. 2-9. In fact, as will be seen, they substantially differ from one another for the different shape/arrangement of the retaining element 150.

As shown, for example with reference to the accompanying figures, the belay device 100 comprises a main body 1 having two main walls 2, 3. Preferably, the main walls are substantially flat. According to a possible embodiment, the main walls 2, 3 can be constrained to one another or anyhow spaced from one another, by means of one or more constraining means 4, 5, 6, or spacing elements having predefined length, as for example a plurality of pins. However, other embodiments, in which different modes for constraining or spacing the main walls 2, 3 from one another are used, are not excluded, or their construction can also be provided in one piece.

The main walls 2 and 3 are preferably constrained in a facing and matching position, i.e. so that to form two, preferably parallel, planes.

The device according to the present invention allows to secure one or more climbers by means of one or more corresponding ropes 10 passed inside the device. In fact, the main body 1 formed by at least two main walls 2, 3 constrained to one another, preferably according to substantially parallel planes, determines the formation of a space, or volume, between the two main facing walls and a rope 10, as for example schematically denoted in FIGS. 1*a*-1*b*, is passed through this space.

It should be noted that according to an aspect of the present invention, the device 100 and in particular the main body 1 develops according to a predominant plane Y, or axis Y', (note that the plane is schematically shown in FIGS. 2*a*-9*a* and denoted by the reference Y, while the axis is schematically denoted in FIG. 10*b* by the reference Y') that is substantially parallel to the predominant plane of extension of the main walls 2, 3. See, for example, the FIGS. 2*a*-9*a* in which the predominant plane Y of development of the body of the device is parallel to the plane of development of each of the main walls 2, 3. It should also be noted that in FIGS. 2-9, the predominant plane also corresponds to the plane A-A according to which the sectional view is taken.

In other words, the inner space (or inner volume) of the body of the device 1, present between the two main walls 2, 3, extends according to a plane Y, or axis Y', that substantially corresponds and is preferably parallel to the extension of the two main walls 2, 3.

It should be noted that the perimeter of the device (or side wall), i.e. the side surface closing the space between the main walls, along the perimeter of the latter, can be closed for example by a covering element or shell.

In the perimeter of the body of the device there is an opening 11 for the coming in and out of the rope 10 and this opening 11 substantially develops so that to intersect, and preferably so that to be substantially perpendicular to the plane of extension of the main walls 2, 3, and therefore so that to intersect, and preferably be perpendicular to the predominant axis Y' or plane Y of development of the device. In other words, the opening 11 that allows the insertion of the rope 10 is arranged so that the axis Y' or the plane Y pass through the opening 11.

It should be noted that, in the accompanying FIGS. 1*a* and 2*b*-9*b*, the rope 10 on the outside of the device before it is inserted through the opening 11 is shown in the upper part of these figures. The opening 11 for the coming in and out of the rope 10 is directly connected with the volume (space) between the two main walls 2, 3.

In FIGS. 1*b*, 1*c* and in FIGS. 2*b*-9*b* (inside the body of the device and with the dashed line) the rope 10 is depicted after it has been inserted inside the body of the device.

Once inserted inside the body of the device, the rope 10 has a substantially U-bent shape and two portions (or ends) 10*a*, 10*b* can be passed at the opening 11. For this reason, the opening 11 will also be denoted hereinafter as the opening for the coming in and out of the rope given that, in use condition, (i.e. with the rope inserted in the body of the device) the rope "comes in and comes out" of the device, having a U-bent portion and two ends or portions 10*a*, 10*b* that can be passed through the opening 11.

The perimeter of the opening 11 is substantially defined by the end of the two main walls 2, 3. Moreover, as will be better shown hereinafter, the device comprises a surface or friction element 12 that cooperates with the braking element 15 to determine the braking and/or blocking of the first portion or end 10*b* of the rope 10, while in a substantially opposed position (looking at the device according to a plane parallel to the plane according to which the main walls extend) there is a supporting or surface element 121 for the second end 10*a* of the rope 10.

According to a possible embodiment, as for example shown in the perspective views of FIGS. 10*a* and 10*b*, the perimeter of the opening 11 can be defined by the two main walls 2, 3, by the friction element 12 and by the supporting element 121 for the second end 10*a* of the rope.

In other words, according to an aspect of the present invention, the opening 11 has a substantially rectangular passage section in which the two opposed largest sides are defined by the end or edge of the main walls 2, 3, and the two smallest sides are defined by the friction element 12 and the supporting element 121 (see for example the perspective view of FIGS. 10*a*, 10*b*).

As will be shown in detail hereinafter, the opening 11 can be at least partially covered and therefore have a reduced passage section, by means of a lid 80.

It should be noted that the main walls 2, 3 can be made of only one material or can be formed by two materials that are constrained, or anyhow combined, to one another. For example, the main walls 2 and 3 can be made of a metal material, for example with high mechanical characteristics and little weight, or they can be made only in part of a first material and comprise a further part formed by a second material, for example a plastic material. For example, the shell or covering layer can be used at least in part for the formation of the main walls 2, 3.

It should be noted that here and hereinafter, the embodiment in which the device is provided with two main walls 2, 3 adapted to form a space between them will be referred to. Obviously, it is also possible to provide the device with other main walls, or to place side by side and constrain more devices 100 to one another so that to form more than one space between the two main facing walls, and therefore to be able to use more than one rope 10 (each inserted in a respective space between two main walls) and therefore to belay one or more climbers or one climber with more ropes.

According to an aspect of the present invention, each main wall 2, 3 further comprises an opening 8 that defines at least in part a movement path (schematically shown in the accompanying figures with the dashed line denoted by the reference P) for at least one braking element 15 of the rope 10 that is movable in the opening 8 between at least one non-blocking position of the rope and at least one braking/blocking position of the rope.

As previously mentioned, hereinafter, the movement of the braking element in the opening will be referred to in order to denote the relative movement between the braking element and the body of the device, which determines the reaching, by the braking element 15, of different positions along the movement path P and in particular at least one non-blocking position of the rope and at least one braking/blocking position of the rope.

It should immediately be noted that, even if a karabiner 15 hooked to the body of the device by means of the passage in the opening 8 and in particular by means of the passage in both openings 8 is in some cases specifically referred to in the accompanying figures and in the following description, the braking element 15 used is not limited to the karabiner and can comprise similar connecting elements, preferably of closed shape as for example a ring, but can also comprise a sleeve, preferably cylindrical and movable in the opening 8.

The cylindrical sleeve can be used for the passage of a karabiner, or a ring, or similar connecting element through its through-hole.

According to an aspect of the invention, the profile or perimeter 8" of the opening 8 obtained on the main walls 2, 3 preferably so that to match between the two walls, substantially determines the shape of the movement path P of the braking element 15 that is movable inside the opening. The opening 8 is preferably shaped so that to substantially define a movement path of the braking element 15 for reaching a first non-blocking position of the rope, in which it is free to run, and a second braking/blocking position of the rope, also named emergency position given it is reached, for example, when the belayed climber loses his grip to stop the free fall.

As will become clearer hereinafter through the present description, with particular reference to FIGS. 1*a*-1*c*, the braking element, as for example the karabiner 15, allows to belay one or more climbers constrained to the end of the rope 10*a* by means of its movement inside the opening 8.

As previously mentioned, the side surface portion 11 of the body of the device remains open, therefore forming the aforesaid opening 11 to allow the insertion of the safety rope 10 inside the body of the device, in the space between the main walls 2, 3.

The operations of inserting the rope 10 inside the device provide that it is substantially "U-bent" for the insertion through the open portion 11 of the outer side surface of the body of the device, until reaching the lower part thereof.

When the karabiner, and in general the braking element 15, is inserted in the opening 8 (and is for example hooked to the opening 8 if a karabiner is used), after the rope was inserted through the open portion 11 and has therefore taken a "U" shape, the same rope 10 passes around the braking element 15 (see for example the rope inserted in the device schematically shown in the figures with the dashed lines). Preferably, when a karabiner, or a ring, is used as braking element 15, the rope 10 inserted in the body of the device can therefore pass inside the closed ring formed by the body of the karabiner.

According to an aspect, the rope 10 must be inserted correctly inside the device so that the end 10*b*, i.e. the one passing near the upper left end in the accompanying figures (and in particular the one passing near to the friction element or surface 12), corresponds to the free end of the rope running inside the device as the climber climbs along the wall, while the end 10*a*, the one passing near the opposed end of the opening 11 for coming in and out of the rope (and therefore at the upper right end of the device with reference to the orientation shown in the figures and therefore the one passing near the supporting element or surface 121) is constrained to the climber to be belayed.

As for example shown in the FIGS. 2*b*-9*b*, the braking element 15 can comprise a karabiner of conventional type that is hooked to the body 1 of the device by passing the open karabiner through the opening 8 of the body of the device, and therefore by passing in the "U" shaped loop of the rope 10 once it was inserted in the opening 11, so that to be hooked to the main walls 2, 3.

Advantageously, when the device is used to belay the first on the rope (leader), both with a single rope and a doubled rope, the braking element and in particular the karabiner 15 carry out the double action of constraining the device to the user (the belayer) that belays the first climber in case of fall, in addition to collaborating with the device itself to achieve the braking and/or blocking of the rope.

In other words, no other karabiners, or equivalent means, are necessary for constraining the device according to the present invention to the user who belays the companion.

As will become much clearer hereinafter with reference to the description of the device operations, the braking element 15, for example the karabiner hooked to the device through the passage in the opening 8, is movable inside the opening itself between a first part 21 of the movement path P (see for example FIGS. 1*a* and 1*b* and FIGS. 2*b*-9*b*) and a second part 22 of the movement path P, and vice-versa. When the braking element 15 is in the first part 21 of the movement path P in the opening 8, the position shown for example in FIGS. 1*a* and 1*b* and in FIGS. 2*b*-9*b*, the device is in the non-blocking position of the rope, i.e. in the position of normal use in which the rope is free to run inside the body 1 of the device.

When the braking element 15 is at the second part 22 of the movement path P in the opening 8, the position for example shown in FIG. 1*c*, the device is in emergency position and therefore in a possible braking/blocking position, depending on the degree of tensioning of the rope and therefore on the degree of stress of the rope, i.e. if the rope will be particularly stressed, it will be braked and/or blocked so that to slow down and/or impede its run.

If the belayed climber falls, the user (the belayer) holds the free end 10*b* of the rope in his hand and the braking element 15 automatically snaps into the braking/blocking position. In fact, due to the fall, the "occupied" end of the rope 10*a* is subjected to a tension that exerts a force onto the braking element, thus causing the relative movement between the braking element and the body of the device, so that the braking element moves along the opening 8 from the first part 21 to the second part 22, in which the device is in the emergency position (of braking/blocking) and the further running of the rope is braked/inhibited.

The profile of the opening 8 can be provided with a protruding zone, or at least a protruding element, preferably constituted by a protruding tooth 20, as for example shown in FIGS. 2-8.

This protruding tooth, and in general the shape of the profile path P, allows the braking element 15 to assume intermediate functions between the free running and the braking and/or the total blocking of the rope 10, in relation to the position of the braking element 15 along the profile path P.

This is particularly advantageous for carrying out certain rope maneuvers known in the climbing sector under the name of "moulinette" or "top rope."

The protruding tooth 20 determines the formation of a first part of the movement path P that is substantially arched around the tooth 20 and a second part of the path closer to the opening 11 for the coming in and out of the rope, which is preferably substantially rectilinear.

In general, it should be noted that the movement path P can have different shapes, can be linear, as for example shown in FIG. 1, or can have a more complex path, for example comprising a curvilinear part, as for example shown in FIGS. 2-8. The presence of a tooth or protruding portion 20 in the perimeter 8", or profile, of the opening 8 allows for example to form one or more curves of the movement path P.

As mentioned, inside the body 1 of the belay device, i.e. inside the space between the main walls 2, 3, there is a friction element or surface 12, also denoted as countering or surface element 12.

The friction element 12 cooperates in generating friction on the rope that, in emergency conditions, determines the braking and/or blocking of the latter. More in detail, the countering element 12, in collaboration with the braking element 15, allows the braking and/or blocking of the rope. In fact, when this braking element moves along the path P in the opening 8 following the tensioning of the rope due to the fall of the belayed climber, the braking element 15 is in the opening portion 8 proximal to the opening 11 of the coming in and out of the rope and determines the compression of the rope between the braking element and the friction element 12.

As shown with particular reference to FIG. 1*c*, when the device is in the braking/blocking position of the rope 10, the latter is squeezed between the countering element 12 and the braking element 15. The running of the rope 10 is braked/blocked due to the friction exerted by the braking element 15 that is forced against the friction element 12 under the effect of the tension of the rope 10.

According to some possible embodiments, as for example shown in FIGS. 2*b*-9*b*, 10*a*-10*b*, the friction element 12 can be provided, on its surface intended to come into contact with the rope, to determine the braking and/or blocking, with one or more notches 45, or grooves (V-shaped for example) or other surface works aimed to increase the friction so that to make the braking and/or blocking more effective.

According to an aspect of the present invention, the device according to the invention comprises at least one retaining element 150 of the braking element 15 in the non-blocking position of the rope along said movement path P. The retaining element 150 is configured to hold directly, and reversibly, the braking element 15 in the non-blocking position of the rope along the movement path P.

According to a possible embodiment, the retaining element 150 is arranged in contact with the braking element 15 to prevent the movement at least from the non-blocking position of the rope towards said at least braking/blocking position of the rope along the movement path P. The contact between the retaining element 150 and the braking element 15 allows to transmit to the braking element a resistive force that counters the displacement of the braking element at least from the non-blocking position towards the braking/blocking position of the rope.

Even if the possible embodiment in which the retaining element 150 is in contact with the braking element 15 will be referred to hereinafter, it should also be noted that in other embodiments according to the present invention, the retaining element may not be in contact with the retaining element and hold the braking element by generating a resistive force onto the braking element, this resistive force counters the movement of the latter and in general the relative movement between the braking element and the body of the device. For example, the retaining element can be configured to generate a magnetic force that counters the displacement, and therefore it generates resistance when the displacement of the braking element from the non-blocking position towards the braking/blocking position of the rope occurs.

According to this possible embodiment not shown in the accompanying figures, the retaining element can comprise a magnet adapted to attract towards itself, and therefore to hold, the braking element made of a material that can be attracted by the magnetic force generated, for example a ferromagnetic material. For example, a braking element comprising a karabiner made of iron can be used in this embodiment.

It should also be noted that the present invention also includes the possibility that the direct retention of the braking element by the retaining element can be carried out by means of the combination of the contact between the retaining element and the braking element (and therefore by means of transmitting a resistive force that counters the displacement of the braking element generated by the contact between these elements) and the generation of a resistive force onto the braking element, for example as mentioned by means of the generation of a magnetic force that attracts the braking element towards the retaining element.

Independently of the implementation method of the retention in a non-blocking position of the rope, it should be noted that in the non-blocking position of the rope, i.e. both the position of the braking element in the opening 8 in which the free running of the rope is not impeded, the braking element is in a position spaced from the friction element 12, as for example shown in FIG. 1*b* and in FIGS. 2*b*-9*b*. The braking/blocking position of the rope in which it is compressed between the braking element 15 and the friction element 12 is shown for example in FIG. 1*c*. For simplicity, the braking/blocking position of the rope is not shown with reference to the possible embodiments in FIGS. 2 to 9, however, it will be reached following the movement of braking element 15 along the path P in the opening 8 towards the friction element 12 (towards the top in the figures) until reaching a position in which the end of the rope 10*b* is compressed between the braking element 15 and the friction element 12.

According to an aspect of the invention, as for example shown in the accompanying figures, the retaining element 150 is arranged so that to intercept, and therefore so that to come into contact with the braking element that is movable in the opening 8. This way, the movement of the braking element 15 from the non-blocking position of the rope 10 (and therefore of normal use of the device in which the rope can freely run inside thereof) towards the braking/blocking position of the rope can be temporarily impeded.

It should be noted that the expression "impeding the movement of the braking element at least from the non-blocking position of the rope towards said at least one braking/blocking position of the rope along said movement path P" is here used to denote that the retaining element 150 can be configured to impede the movement at least when the braking element moves from the non-blocking position towards the braking/blocking position of the rope, however, it is implicit that, also in the opposite movement, i.e. from the braking/blocking position towards the non-blocking position of the rope, the retaining element constitutes at least temporarily an impediment to the return movement towards the non-blocking position of the rope, or anyway the possibility is not to be excluded.

According to an aspect, the retaining element 150 extends inside the profile 8" (schematically shown by a dashed line for simplicity only in FIGS. 1*a* and 2*b*) of the opening 8 to contact the braking element 15, therefore impeding its movement at least from said non-blocking position of the rope towards said at least one braking/blocking position of the rope along said movement path P.

The expression "extends inside the profile 8" of the opening" is herein used to denote that the retaining element 150 is arranged so that to have at least one part thereof protruding inside the profile of the opening 8, i.e. extending beyond the perimeter 8" of the opening 8 and therefore inside the opening 8, for example when looking at the device according to a plane that is substantially parallel to the one of extension of the main walls (as for example in FIGS. 1*a*, 1*b*, 1*c* and 2*b*-9*b*).

The extension of the retaining element 150 inside the profile 8" of the opening 8 makes the retaining element 150 interfere with the movement of the braking element 15 inside the opening 8. In other words, the retaining element 150 is arranged so that to be incident to the movement path P of the braking element 15 inside the opening 8 and therefore so that to determine the contact of at least part of the retaining element 150 with the braking element 15, therefore determining the temporary impediment of the movement at least from the non-blocking position of the rope towards the braking/blocking position of the rope. As mentioned, the contact between the retaining element 150 and the braking element 15 determines the transmission of a resistive force onto the braking element, and in general of a resistance to the movement of the braking element towards the braking/blocking position of the rope.

According to an advantageous aspect of the present invention, the retaining element 150 forms a narrow portion 8' of the opening 8.

In detail, the retaining element determines a reduction of the dimensions of the opening 8, therefore forming a narrow passage section for the braking element 15. This narrow portion 8' has reduced dimensions with respect to other parts of the opening 8 in which the retaining element 150 is not present, so that to generate a resistance to the movement of the braking element 15.

It should be noted that the narrow portion 8' has a dimension D smaller than the minimum dimension D of the braking element 15 movable inside the opening 8. In other words, the passage section for the braking element 15 at the narrow portion 8' of the opening 8, has a smaller dimension D' than the minimum dimension D of the section of the braking element 15 that is moved inside the opening 8 along the movement path P.

In other words, the retaining element 150, which as mentioned preferably extends inside the perimeter of the opening 8, determines a reduction of the passage section for the braking element 15 at a narrow portion 8'.

It should be noted that the dimension D' of the passage as the dimension D of the section of the braking element 15 moving inside the opening 8 can be measured by means of a straight line, or segment, so that to join two points spaced at a smaller distance from one another, as for example visible in the accompanying figures.

For example, in the narrow portion 8' of the opening 8 two points are joined, preferably opposed, that are arranged spaced at a smaller distance D' from one another by means of a segment.

With reference to the section of the braking element 15, two points of the section spaced at a minimum distance D from one another are joined by means of a segment, as for example shown in the accompanying figures. It should be noted that if the section of the braking element 15 is circular, the minimum dimension corresponds to the diameter of the circumference of the section (as for example in the accompanying figures). If the section of the braking element does not have circular section, the minimum distance D is denoted as the minimum distance between two points of the perimeter of the section, or the diameter of the circumference that encloses and/or circumscribes the non-circular section of the braking element 15 can be referred to.

It should also be noted that the narrow portion 8' of the opening 8 can be defined between two parts 150*a*, 150*b* of the retaining element 150, as for example in the embodiment shown in FIGS. 9*a*, 9*b*.

In alternative, the narrow portion 8' of the opening 8 can be defined between the retaining element and at least part of the body 1 of the device, preferably at least part of said main wall 2, 3, and more preferably between at least part of the retaining element 150 and at least part of the perimeter 8" of the opening 8, as for example shown in the embodiment shown in FIGS. 1-8.

According to an aspect of the present invention, the retaining element 150 lies in a plane that is parallel to, or coinciding with, a plane in which a main wall 2, 3 of the body of the device lies.

In other words, as for example shown in the accompanying figures, the retaining element 150 is arranged so that to lie in a plane that is parallel to the main plane Y, or axis Y' of the device and is therefore so that not to interfere, or so that not to extend incidentally or transversely with respect to the volume or space present between the two main walls 2, 3.

In other words, the retaining element 150 is arranged so that not to be housed in the space present between the two main walls 2, 3 so that not to contact the rope 10. This expression means that the retaining element 150 is arranged so that not to interfere with the rope 10 and with its movement, contrarily to what occurs in the known device described in WO2011/007225, always in the name of the Applicant, in which the lever arranged in the space between the two walls of the body of the device is adapted to come into contact with the rope.

As for example shown in the accompanying figures, in the device according to the present invention, the rope 10 inserted inside the body of the device does not contact the retaining element 150 since the latter is arranged sideways and outwardly with respect to the rope 10. In particular, the retaining element 150 is arranged sideways with respect to the space necessary for the passage of the rope and anyhow extends in parallel to this plane or space so that not to interfere, and therefore so that not to intercept or contact, the rope 10 during use.

Moreover, the rope 10 can be arranged underneath the retaining element 150, for example underneath the portion of the retaining element 150 extending inside the perimeter of the opening 8.

According to an aspect of the present invention, the retaining element 150 holds the braking element 15 reversibly and therefore in a releasable way, as long as the force exerted by the braking element 15 onto the retaining element 150, preferably following the tensioning of the rope (due for example to the fall of the climber belayed at the end 10*a*), does not overcome the predefined threshold, for example between 1 and 40 N, preferably between 10 and 30 N.

The threshold value, beyond which the braking element 15 overcomes the resistance to its displacement provided by the retaining element 150, is suitably chosen so that, during the normal operations of the device and therefore for example for tensioning of the rope due to its normal running inside the device, for example if the belayer is feeding rope to the belayed climber as the latter is climbing up the wall, the displacement of the braking element towards the braking/blocking position of the rope does not occur and is effectively held in the non-blocking position of the rope.

The threshold value is instead so that, when the tensioning of the rope reaches a value greater than the one reached during normal use, for example due to the fall or slipping of the belayed climber, the tension of the rope is transferred to the braking element that will therefore tend to move away from the non-blocking position of the rope, moving forward along the movement path P. The force exerted by the braking element is in this case so that to overcome the resistance transmitted and/or generated by the retaining element and therefore the braking element is no longer held in the non-blocking position.

It should be noted that according to some possible embodiments, the predefined threshold can be established during the design and production of the belay device according to the present invention, for example by means of one or more parameters comprising the geometric shape and/or dimensions of the retaining element 150, the material of which the retaining element is made, or the presence of suitable preloading means of the retaining element.

With reference to the preloading means, according to possible embodiments, the movement or deformation of the retaining element can be controlled by preloading means, such as for example 2 opposed magnets, or a spring, or similar elastic means acting on a portion of the retaining element, so that to maintain it in the operative position in which it holds the braking element in the non-blocking position of the rope.

In the embodiment in which the retaining element generates a resistive force onto the braking element, for example a magnetic force countering the moving away of the braking element from the non-blocking position of the rope, the threshold can be chosen for example by modifying the magnetic force generated by the retaining element and therefore for example by modifying the magnet used.

According to an aspect of the invention, the retaining element 150 is movable and/or at least partially deformable, preferably reversibly, between an operative position in which it is arranged and interacts, for example in contact, with said braking element 15 and impedes its movement at least from the non-blocking position towards the at least one braking/blocking position along said movement path P, and at least one non-operative position in which the movement of the braking element 15 along the movement path P, at least from the non-blocking position towards the braking/blocking position, is allowed.

In fact, the retaining element 150 is configured so that to be movable, or deformable, and therefore to be displaced or deformed from a position in which it contacts the karabiner and preferably determines a narrowing of the opening 8 so that to impede the movement of the braking element.

The yielding and/or deformation and/or movement and in general the overcoming of the resistive force countering the displacement towards the braking/blocking position of the rope, transmitted and/or generated by at least part of the retaining element 150, preferably caused by the interaction and/or contact itself of the braking element that tends to move in the opening towards the braking/blocking position of the rope due to the tensioning of the rope itself due to the fall of the leader or first belayed on the rope, determines the temporary yielding, or the movement, or the deformation of the retaining element 150 towards a non-operative position so that to allow the movement of the braking element 15 towards the braking/blocking position of the rope 10.

According to an aspect of the present invention, in the non-operative position, the retaining element 150 is displaced, or deformed, so that to temporarily increase the dimensions of the narrow portion 8' in the opening 8 so that to allow the passage of the braking element through this portion and therefore towards the braking/blocking position of the rope 10.

As mentioned above, it should be noted that according to possible embodiments, the geometric shape of the retaining element and/or the characteristics of the material of which the retaining element is made and/or the preloading means of the retaining element are adapted to modify the resistance transmitted and/or generated by the retaining element 150, so that to modify the threshold at which the movement of the braking element towards the non-blocking position of the rope is allowed.

In fact, when the device is in a non-blocking position of the rope 10 and the braking element 15 is in the first part 21 of the movement path P in the opening 8 (position shown in FIG. 1*b* and in FIGS. 2*b*-9*b*), the retaining element 150 interacts with, and/or contacts, the braking element 15 and impedes its passage towards the non-blocking position of the rope, i.e. in the second part 22 of the movement path P, preventing its displacement along the opening 8 and therefore along the movement path P.

This way, the person, for example the belayer, to whom the device is constrained, can make the rope run freely inside the device without risking that the braking element 15 displaces accidentally along the path P, therefore determining the undesired reaching of the braking/blocking position of the rope.

In emergency conditions, the tensioning of the rope (and in particular of its occupied end 10*a*), and therefore the force exerted by the rope 10 onto the braking element 15, determines the relative movement between the braking element 15 and the body of the device and therefore a relative displacement of the braking element 15 and the application onto the retaining element 150 (interacting among one another) of a force able to overcome the resistance transmitted and/or generated by the retaining element 150, determining for example a yield and/or the movement and/or deformation of the retaining element.

For example, in the embodiment in which the retaining element 150 extends inside the perimeter of the opening 8, the narrow portion 8' temporarily increases its dimension D' since the retaining element 150 is at least partially displaced and/or deformed towards its non-operative position to allow the movement of the braking element 15 along the opening 8 until reaching the braking/blocking position of the rope in the second part 22 of the path P. In the embodiment in which the retaining element generates a force onto the braking element, for example of the magnetic type, the force exerted by the rope determines the overcoming of the threshold of the magnetic force and therefore the braking element can displace towards the braking/blocking position of the rope.

According to a possible embodiment, when the braking element 15 has reached the second part 22 of the path P to determine the braking/blocking of the rope 10, the retaining element is once again able to obstruct its passage. For this reason, when it is necessary to bring the device back to the non-blocking position of the rope, the user must manually move the body of the device (i.e. determine the relative movement between the braking element and the body of the device) so that to overcome the resistance transmitted and/or generated by the retaining element and to move the braking element 15 along the opening 8 of the second part 22 towards the first part 21 of the path P.

According to a possible embodiment, also in this case, in order to carry out this operation a force so that to overcome the resistance transmitted and/or generated by the retaining element onto the braking element, countering the movement of the braking element in the opening 8, in this case from the braking/blocking position towards the non-blocking position of the rope, must be exerted.

The force of the retaining element 150 can, for technical and constructive and functional reasons, be of different extents, i.e. the force imposed by the retaining element 150 can have a certain extent while the braking element 15 will displace from the part 21 to the part 22 of the path P, and be of different extent to return from the part 22 to the part 21.

Obviously, the retaining element 150 according to the present invention can be of multiple shapes, dimensions and constructive materials. For example, the device can comprise only one retaining element, or can comprise two (or more) retaining elements (for example one for each main wall, as for example shown in FIGS. 2-10).

As already mentioned, in alternative to or in combination with the embodiment in which the retaining element is in contact with the braking element to determine its direct holding, it is possible that the retaining element generates a resistive force, for example of the magnetic type, countering the displacement of the braking element towards the braking/blocking position, for example by attracting the braking element towards the retaining element itself by means of magnetic force.

For example, in the general embodiment of FIGS. 1*a*-1*c*, the retaining element 150 is generically denoted as an element adapted to come into contact with the braking element and that, as mentioned, can be movable and/or deformable to impede the passage of the braking element inside the opening 8 along the movement path P.

According to some possible embodiments, the retaining element 150 is chosen between a spring, a leaf or a wire, which are preferably elastically deformable. It should be noted that spring means an elastically deformable body and therefore able to return to its undeformed condition when it is not stressed. The spring can for example comprise a body having one or more coils, but can also be devoid of coils or spiral parts, and comprise a portion constrained to the device at a free end, or having two opposed ends constrained to the body of the device that are substantially deformable at a central part or anyhow arranged between the two ends.

The retaining element 150 can have two side ends, or only one end, constrained to the body of the device so that to be deformed and/or have a movement and/or deformation component that allows to impede the movement of the braking element and simultaneously to be able to be displaced or deformed to a non-operative position in which the movement of the braking element is allowed.

Also the material of which the retaining element 150 is made can be suitably chosen on the basis of the constructive requirements, for example the retaining element 150 can be made of metal material, or other elastically deformable material.

For example, a plastic material with characteristics of elastic deformability can be used.

According to possible embodiments, the retaining element 150 can be constrained to the body of the device (as for example shown in the embodiment depicted in the FIGS. 2, 3, 4, 7 and 8), or can be made in one piece with the body 1 of the device, preferably with at least one main wall 2, 3, as for example occurs in the embodiment of FIGS. 5, 6 and 9.

In the embodiment shown in FIGS. 2, 2*b*, the retaining element 150 comprises a wire, preferably made of harmonic metal material, that is constrained at its two ends to two portions of the body of the device so that to have a portion, preferably a substantially central portion, extending inside the perimeter of the opening 8, that is configured to come into contact with the braking element 15 movable inside the opening.

According to an aspect of the invention, the retaining element 150 comprises two portions 150', 150" (schematically shown only in FIG. 2*b*) that are reciprocally tilted so that the reduction of the dimension of the passage section of the opening, and therefore the formation of the narrow portion 8' of the opening 8, is gradual, preferably with a reduction that increases, and therefore with the dimension D' that decreases, along the movement path P from the non-blocking position of the rope towards the braking/blocking position of the rope.

With reference to FIGS. 3, 4, 7 and 8, these embodiments comprise a retaining element 150 made by a spring, or wire, or leaf or other element, having a portion constrained to the body of the device and a free terminal end.

The embodiment of FIGS. 4, 7 and 8 are similar to one another both in shape and for the positioning of the constraint point of the spring to the body of the device (see the lower right part of the body of the device when looking at the figures).

The part constrained to the body of the device in which the spring can provide one or more coils, can be arranged in different points or zones depending on different possible embodiments, as long as a portion of the spring, arranged to interact and/or contact the braking element and therefore preferably extending inside the perimeter (or profile) of the opening 8, is provided.

In the embodiment of FIGS. 7 and 8, the retaining element 150, which is arranged in contact with the braking element 15, is coated with a low friction coefficient material 150*c*, for example a plastic material, so that to reduce the friction and therefore the wearing of the part following the contact with the braking element. Although an embodiment, in which the retaining element is coated with a low friction coefficient material, was referred to, possible embodiments in which the retaining element is made at least in part of low friction coefficient material should not be excluded.

According to some possible embodiments, as previously mentioned, the retaining element 150 can be made in one piece with at least part of the body of the device, for example made in one piece with a main wall 2, 3 or with at least part of a shell or coating layer, for example made of plastic material, of the body of the device.

For example, in the embodiment of FIGS. 5 and 6, the retaining element is configured like a leaf, or wire, made in one piece with the body of the device and in particular with the shell that covers the body of the device, so that to have a free end that juts out of the body of the device and that contacts the braking element 15 to impede its movement in the opening 5.

In the embodiment in FIG. 9, the retaining element comprises two parts 150*a* and 150*b* jutting out of the body 1 and arranged facing one another so that to form a narrow passage portion for the braking element 15.

Obviously, the embodiments described herein with reference to the figures are only some possible embodiments of the retaining element that are available for the technician of the sector.

As previously described, the rope 10 must be inserted correctly inside the device. If the rope is involuntarily inserted incorrectly, i.e. with the end that is constrained to the climber to be belayed passing in the portion of the opening 11 near the friction element 12 and with the free end passing at the supporting element 121 and anyhow passing in an position opposed the one in which the countering element 12 is arranged, the belay device according to the present invention is anyhow able to ensure the braking and/or blocking of the rope and to prevent the fall of the belayed climber.

In fact, as shown in the accompanying figures, the upper part of the main walls 2 and 3 is shaped so that to comprise a throat 50 on each of them to ensure the braking and/or blocking of the rope whenever the latter is inserted incorrectly inside the device.

The throat 50 is arranged on the main wall 2, 3 substantially in proximity of the supporting element 121, or anyhow in a position substantially opposite the one in which the countering element 12 is arranged.

If the belayed climber falls, the end 10*b* that passes in proximity of the countering element 12 and that is incorrectly constrained to the climber, is tensioned, but the device, being used incorrectly, does not snap into the emergency position, or is not anyhow able to exert friction so that to allow the braking and/or blocking of the rope.

The end of the rope, under the effect of the tension due to the weight of the climber falling, tends to automatically arrange, or is anyhow forced to pass by the user who secures the companion, inside the throats 50 that allow to exert friction on the rope, thus determining its braking and/or blocking. The throats 50 are suitably shaped so that to facilitate the arrangement of the end 10*a* of the rope or ropes inside them and to exert sufficient friction to determine the braking and/or blocking.

It should anyhow be specified that the throats 50 ensure the braking and/or blocking of the rope in an incorrect use condition of the device, which must not be preferred over the one shown in the figures.

According to an aspect of the present invention, the belay device 1 further comprises a lid 80 adapted to cover at least partially the opening 11 intended, as mentioned, for the coming of the rope 10 in/out of the device 1. More in detail, the opening 11 of the body of the device is at least partially obstructed by a lid 80.

The lid 80 is preferably movable between at least one operative position (for example visible in FIGS. 2-7, 9, 10*a*) in which it obstructs, and therefore occupies, at least part of the passage section of the opening 11, and one non-operative position (for example shown in FIG. 10*b*) in which it does not obstruct the passage section of the opening.

According to a possible embodiment, the lid 80 is arranged so that to substantially divide the opening 11 in two portions 11*a*, 11*b* separated from one another by the lid 80. In other words, the lid 80 is substantially arranged in a centered position in the opening 11 so that it is separated in two portions 11*a*, 11*b* that are spaced and separated from one another.

This arrangement of the lid 80 allows to effectively provide two passage sections, each for a respective end 10*a*, 10*b* of the rope coming in and out of the device. In other words, the substantially U-bent rope 10 is inserted in the device, preferably when the lid is in a non-operative position (for example raised) and therefore does not obstruct the opening 11. Once inserted and when the device is in an operative position (for example lowered), the two ends of the rope 10*a* and 10*b* will be separated from one another by means of the lid 80.

In fact, the lid acts as a separating element for the two ends 10*a*, 10*b* of the rope 10. In fact, each end 10*a*, 10*b* passes through a respective portion 11*a*, 11*b* of the opening 11, formed by the presence of the lid 80.

Advantageously, the presence of the lid 80 contributes to maintain the ends 10*a*, 10*b* coming in and coming out of the device separated from one another, so that they can be effectively maintained separated and parallel to one another during the operations.

According to an aspect of the present invention, the lid 80 substantially extends perpendicularly with respect to the planes according to which the main walls 2, 3 of the device (and therefore the lid is also substantially perpendicular to the predominant plane Y of development of the body of the device) extend.

According to a possible embodiment, as for example shown in the figures, the lid 80 is constrained so that to be rotatable between the operative and non-operative positions.

According to a possible embodiment, the lid 80 is rotatable around an axis Z that lies in a plane that is parallel with respect to the planes according to which the main walls 2, 3 of the device (and therefore also with respect to the predominant plane Y or axis Y' of development of the body of the device) extend.

Obviously, other possible forms of movement constraint and/or method (for example rotation) of the lid 80 with respect to the body of the device are not to be excluded.

Moreover, according to an advantageous aspect, the lid 80 is arranged so that to interfere, and more in particular so that to be in contact, with the end of the rope 10*b* that is tensioned by the hand of the belayer during operations, for example when it must hold back a fall of the belayed climber.

The contact with the lid 80 of the tensioned end 10*b* of the rope allows the generation of a greater transmission of the force onto the braking element 15 (due to the tensioning of the rope) that, overcoming the retention of the retaining element 150, can move towards the braking/blocking position of the rope.

It should be noted that the lid 80 is present in the embodiments shown in FIGS. 2-7, 9 and 10*a*, but that these embodiments may also not be provided with this component. On the contrary, the embodiment in FIG. 8, which is not provided with this component, can also be provided with the lid 80 in a variant.

The invention claimed is:

1. Belay device (100) for braking and/or blocking at least one rope (10), comprising a main body (1) having at least two main walls (2, 3), the latter facing one another and being spaced from one another to form a space therebetween, an opening (11) for access to the space between the two main walls, said at least one rope (10) being adapted to be inserted through said opening (11) in the body (1) of the device in the space between said two main walls (2, 3), each main wall further comprising an opening (8) defining a movement path (P) for at least one braking element (15) of the rope which is movable in said opening (8) between at least one non-blocking position of said at least one rope and at least one braking/blocking position of said at least one rope, the device further comprising at least one friction element or surface (12), said at least one rope (10) being arranged between said braking element (15) and said friction element or surface (12) when said braking element (15) is in said braking/blocking position of the rope, characterized in that it comprises at least one retaining element (150) configured to hold directly, and reversibly, said braking element (15) in said at least one non-blocking position of the rope along said movement path (P).

2. Device according to claim 1, wherein said retaining element (150) is arranged in contact with said braking element (15).

3. Device according to claim 1, wherein said retaining element (150) is movable and/or at least partially deformable between an operative position in which it holds, and prevents the movement thereof at least from said non-blocking position towards said at least one braking/blocking position along said movement path (P), and at least one non-operative position in which it allows the movement of said braking element (15) along the movement path (P) at least from said non-blocking position towards said braking/blocking position.

4. Device according to claim 1, wherein said retaining element (150) reversibly holds said braking element (15) until the force exerted by said braking element (15) onto said retaining element (150), as a result of the tensioning of the rope, overcomes a predefined threshold.

5. Device according to claim 4, wherein said predetermined threshold is selected by at least one of the following parameters: the geometrical shape and/or the size of the retaining element, the material the retaining element is made of, preloading means of the retaining element; or a combination thereof.

6. Device according to claim 1, wherein the retaining element (150) extends into the profile (8") of the opening (8) to come into contact with said braking element (15) thus preventing the movement thereof from said non-blocking position of the rope towards said at least one braking/blocking position of the rope along said movement path (P).

7. Device according to claim 1, wherein said retaining element (150) forms a narrow portion (8') of the opening (8), said narrow portion having size (D') smaller than the minimum size (D) of the braking element (15) movable in said opening (8).

8. Device according to claim 7, wherein said narrow portion (8') of the opening (8) is defined between two parts (150*a*, 150*b*) of the retaining element (150), or it is defined by the retaining element and at least part of the body (1) of the device, preferably at least part of said main wall (2, 3).

9. Device according to claim 1, wherein said retaining element (150) is selected among a spring, a leaf or a wire.

10. Device according to claim 1, wherein said retaining element (150) is made of metal material, or another elastically deformable material.

11. Device according to claim 1, wherein said retaining element (150) is constrained to, or is made in one piece with, the body (1) of the device, preferably with at least one main wall (2, 3).

12. Device according to claim 1, wherein at least part of the retaining element (150) is made of, or is coated with, a material or element (150*c*) having low friction coefficient.

13. Device according to claim 1, wherein said retaining element (150) lies in a plane parallel to, or coincident with, a plane in which at least one main wall (2, 3) of the device body lies.

14. Device according to claim 1, wherein said movable braking element (15) is selected among a karabiner, a ring, or a sleeve, said sleeve being preferably cylindrical.

15. Device according to claim 1, wherein said retaining element (150) holds directly, and reversibly, said braking element (15) generating a resistive force countering the movement of said braking element (15) from at least said non-blocking position of the rope towards said at least one braking/blocking position of the rope.

16. Device according to claim 15, wherein said retaining element (150) comprises a magnet, or is magnetized, for generating said magnetic force countering the movement of said braking element (15), said braking element (15) being made of a material that is attracted by the magnetic force generated by the retaining element (150).

17. Device according to claim 3, wherein said retaining element (150) is movable and/or at least partially deformable in a reversible way, between an operative position in which it holds, and is in contact with, said braking element (15) and prevents the movement thereof at least from said non-blocking position towards said at least one braking/blocking position along said movement path (P), and at least one non-operative position in which it allows the movement of said braking element (15) along the movement path (P) at least from said non-blocking position towards said braking/blocking position.

18. Device according to claim 9, wherein said retaining element (150) is elastically deformable.

19. Device according to claim 15, wherein said resistive force is a magnetic force.

20. Device according to claim 16, wherein said braking element is made of ferromagnetic material.

* * * * *